US012291852B2

(12) United States Patent
Ogasawara et al.

(10) Patent No.: US 12,291,852 B2
(45) Date of Patent: May 6, 2025

(54) MOVEMENT IDENTIFICATION DEVICE

(71) Applicant: Hitachi Construction Machinery Co., Ltd., Tokyo (JP)

(72) Inventors: Keita Ogasawara, Tsuchiura (JP); Akio Hoshi, Tsuchiura (JP); Shunichi Suda, Tsuchiura (JP); Hiroshi Kanezawa, Tsuchiura (JP); Takeshi Shiina, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 723 days.

(21) Appl. No.: 17/640,047

(22) PCT Filed: Sep. 30, 2019

(86) PCT No.: PCT/JP2019/038471
§ 371 (c)(1),
(2) Date: Mar. 3, 2022

(87) PCT Pub. No.: WO2021/064777
PCT Pub. Date: Apr. 8, 2021

(65) Prior Publication Data

US 2022/0396933 A1 Dec. 15, 2022

(51) Int. Cl.
*E02F 9/26* (2006.01)

(52) U.S. Cl.
CPC ..... *E02F 9/267* (2013.01); *E02F 9/264* (2013.01)

(58) Field of Classification Search
CPC ..... E02F 9/267; E02F 9/264; E02F 9/2285; E02F 9/2296; E02F 9/2278; E02F 3/435;
(Continued)

(56) References Cited

U.S. PATENT DOCUMENTS 6,314,818 B1 * 11/2001 Mandon ..... E02F 9/24 73/781
9,315,970 B2 * 4/2016 Chitty ..... G07C 5/006
(Continued)

FOREIGN PATENT DOCUMENTS

JP 2001-183222 A 7/2001
JP 2007-51781 A 3/2007
(Continued)

OTHER PUBLICATIONS

International Search Report (PCT/ISA/210) issued in PCT Application No. PCT/JP2019/038471 dated Dec. 3, 2019 with English translation (four (4) pages).
(Continued)

*Primary Examiner* — Dapinder Singh
(74) *Attorney, Agent, or Firm* — Crowell & Moring LLP

(57) ABSTRACT

Provided is a movement identification device capable of identifying a specific motion of a construction machine based on the output of a sensor attached to the construction machine with higher accuracy than the conventional technology. A movement identification device 100 includes a waveform generation unit 111, a waveform storage unit 121, and a motion identification unit 112. The waveform generation unit 111 generates a force waveform based on the signal of a force sensor that detects the force acting on the construction machine and an attitude waveform based on the signal of an attitude sensor that detects the attitude of the construction machine. The waveform storage unit 121 stores reference waveforms, which are combinations of force waveforms and attitude waveforms corresponding to specific motions. The motion identification unit 112 compares a motion waveform, which is a combination of a force waveform and an attitude waveform corresponding to an arbitrary motion of a construction machine, with the reference waveforms stored in the waveform storage unit 121 to
(Continued)

identify a specific motion in the arbitrary motion of the construction machine.

4 Claims, 14 Drawing Sheets

(58) Field of Classification Search
CPC ... E02F 3/43; E02F 3/42; G01M 1/02; G01M 1/10; G01M 1/12; G01M 7/08; G01M 7/00
See application file for complete search history.

(56) References Cited

U.S. PATENT DOCUMENTS

| | | | | |
|---|---|---|---|---|
| 9,540,008 | B2 * | 1/2017 | Ichinose | G05D 1/0223 |
| 10,620,082 | B2 * | 4/2020 | Unuma | G01M 5/0033 |
| 11,242,672 | B2 * | 2/2022 | Hyodo | E02F 9/20 |
| 11,814,818 | B2 * | 11/2023 | Ogasawara | G01M 17/03 |
| 2005/0177292 | A1 | 8/2005 | Okamura et al. | |
| 2009/0132131 | A1 | 5/2009 | Takeda et al. | |
| 2010/0100338 | A1 * | 4/2010 | Vik | G01M 5/0033 702/42 |
| 2018/0100290 | A1 | 4/2018 | Greer | |
| 2020/0024831 | A1 | 1/2020 | Okada et al. | |
| 2020/0115882 | A1 | 4/2020 | Sano et al. | |
| 2020/0407945 | A1 | 12/2020 | Okada | |

FOREIGN PATENT DOCUMENTS

| | | | |
|---|---|---|---|
| JP | 2010-121441 | A | 6/2010 |
| JP | 2015-190114 | A | 11/2015 |
| JP | 2016-3462 | A | 1/2016 |
| JP | 2018-112065 | A | 7/2018 |
| JP | 2019-7175 | A | 1/2019 |
| WO | WO 2006/129399 | A1 | 12/2006 |
| WO | WO 2018/180555 | A1 | 10/2018 |
| WO | WO 2019/182128 | A1 | 9/2019 |

OTHER PUBLICATIONS

Japanese-language Written Opinion (PCT/ISA/237) issued in PCT Application No. PCT/JP2019/038471 dated Dec. 3, 2019 (five (5) pages).

Japanese-language International Preliminary Report on Patentability (PCT/IPEA/409) issued in PCT Application No. PCT/JP2019/038471 dated Sep. 8, 2021 including Annexes with partial English translation (21 pages).

* cited by examiner

MOVEMENT IDENTIFICATION DEVICE

TECHNICAL FIELD

The present disclosure relates to movement identification devices for construction machines.

BACKGROUND ART

Conventionally inventions about an excavator support device have been known, which assists in detecting incompatibility (mismatching) of a combination for the work content and the work environment and the excavator in operation (see Patent Literature 1 below). This conventional invention aims to provide an excavator support device capable of accurately determining whether or not an excavator in operation is suitable for the current work content and work environment.

According to one aspect of this conventional invention, an excavator support device includes a display screen that displays an image and a processor that controls the display screen to display an image thereon (see this document, claim 1, paragraph 0005, for example). The processor acquires the time history of the evaluation value about the cumulative damage degree that is accumulated in the excavator part to be evaluated. The processor compares the evaluation value of cumulative damage degree with a threshold for determination, which increases with operating time. The threshold is for determining whether or not the excavator to be evaluated is in a mismatch condition. If the evaluation value exceeds the threshold, the processor then notifies that the excavator to be evaluated is in a mismatch state.

For this conventional excavator support device, a management device that receives operation information from the excavator can estimate what the excavator is doing, such as ground excavation, excavation at high place, rock excavation, loading, ground leveling, slope leveling, and dismantling, based on the time history of the attachment's attitude (see paragraph 0023 of the document).

CITATION LIST

Patent Literature

Patent Literature 1: JP 2016-003462 A

SUMMARY OF INVENTION

Technical Problem

In the conventional excavator support device as described above, the management device estimates the work content of the excavator based on the time history of the attitude of the attachment. Therefore, the management device might erroneously estimate a work content based on the time history of the attachment attitude similar to the work content of the excavator, even when the excavator is not actually performing that work.

The present disclosure provides a movement identification device capable of identifying a specific motion of a construction machine based on the output of a sensor attached to the construction machine with higher accuracy than the conventional technology.

Solution to Problem

An aspect of the present disclosure is a movement identification device that includes: a waveform generation unit configured to generate a force waveform based on a signal of a force sensor that detects a force acting on a construction machine and an attitude waveform based on a signal of an attitude sensor that detects an attitude of the construction machine; a waveform storage unit that stores a reference waveform, which is a combination of the force waveform and the attitude waveform corresponding to a specific motion of the construction machine; and a motion identification unit configured to compare a motion waveform, which is a combination of the force waveform and the attitude waveform corresponding to an arbitrary motion of the construction machine, with the reference waveform to identify the specific motion contained in the arbitrary motion.

Advantageous Effects of Invention

According to the above-described aspect of the present disclosure, it is possible to provide a movement identification device capable of identifying the type of motion of a construction machine based on the output of a sensor attached to the construction machine with higher accuracy than the conventional technology.

DESCRIPTION OF EMBODIMENTS

The following describes an embodiment of a movement identification device according to the present disclosure, with reference to the drawings.

Embodiment 1

Figure 1:
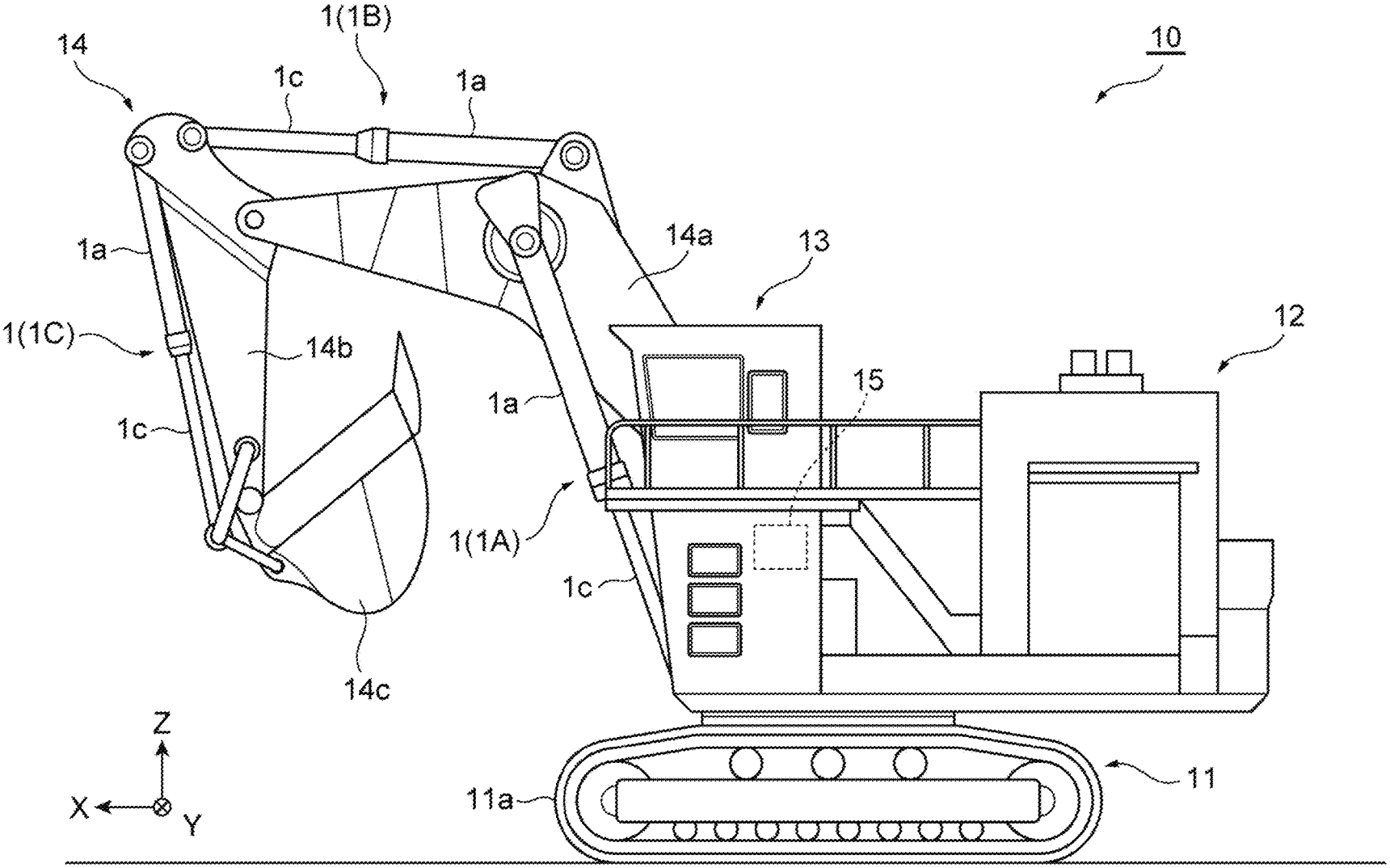
FIG. 1 is a side view of a hydraulic excavator equipped with a movement identification device according to Embodiment 1 of the present disclosure.
Figure 2:
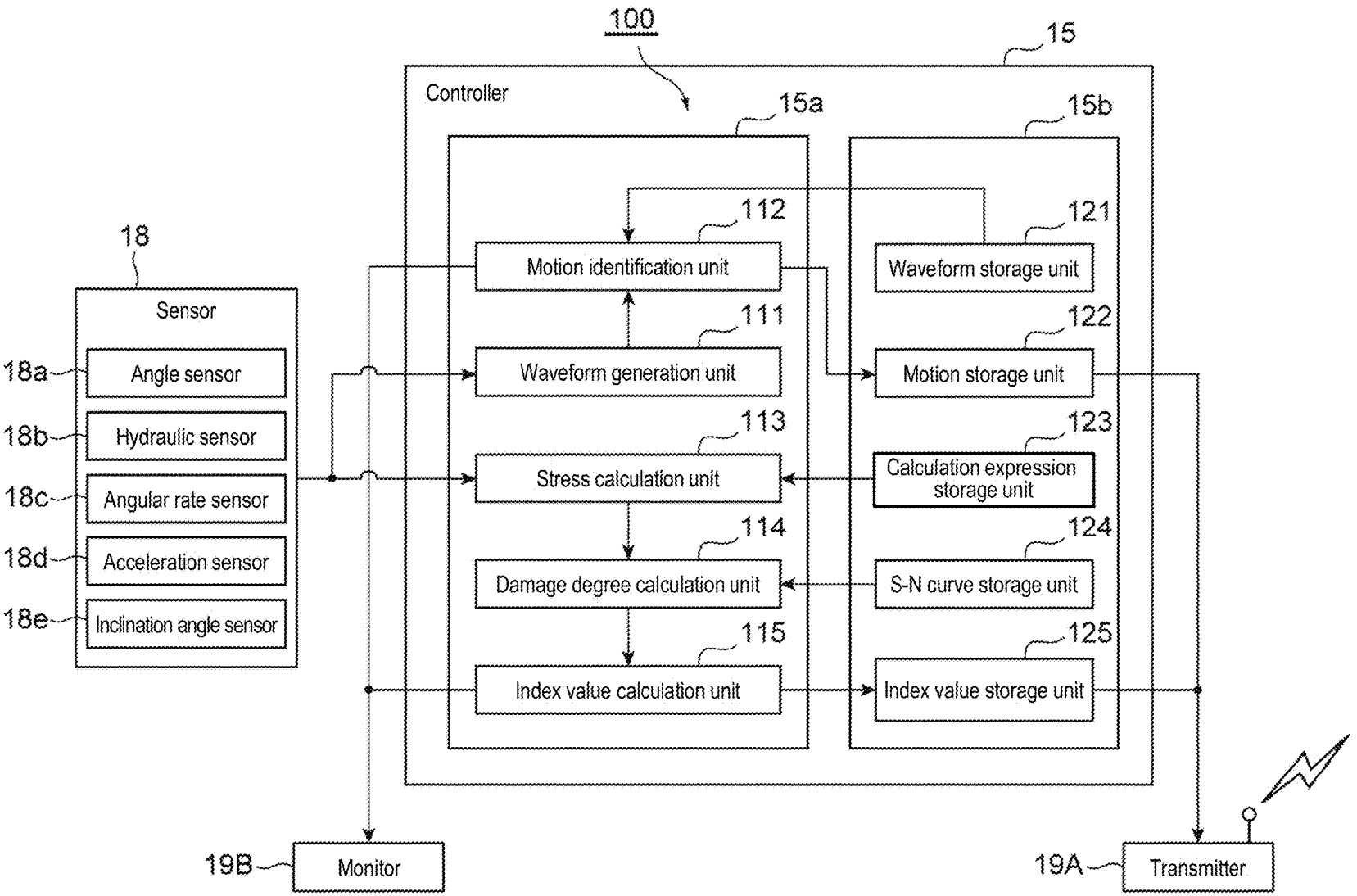
FIG. 2 is a block diagram of the movement identification device mounted on the hydraulic excavator of FIG. 1.
Figure 3:
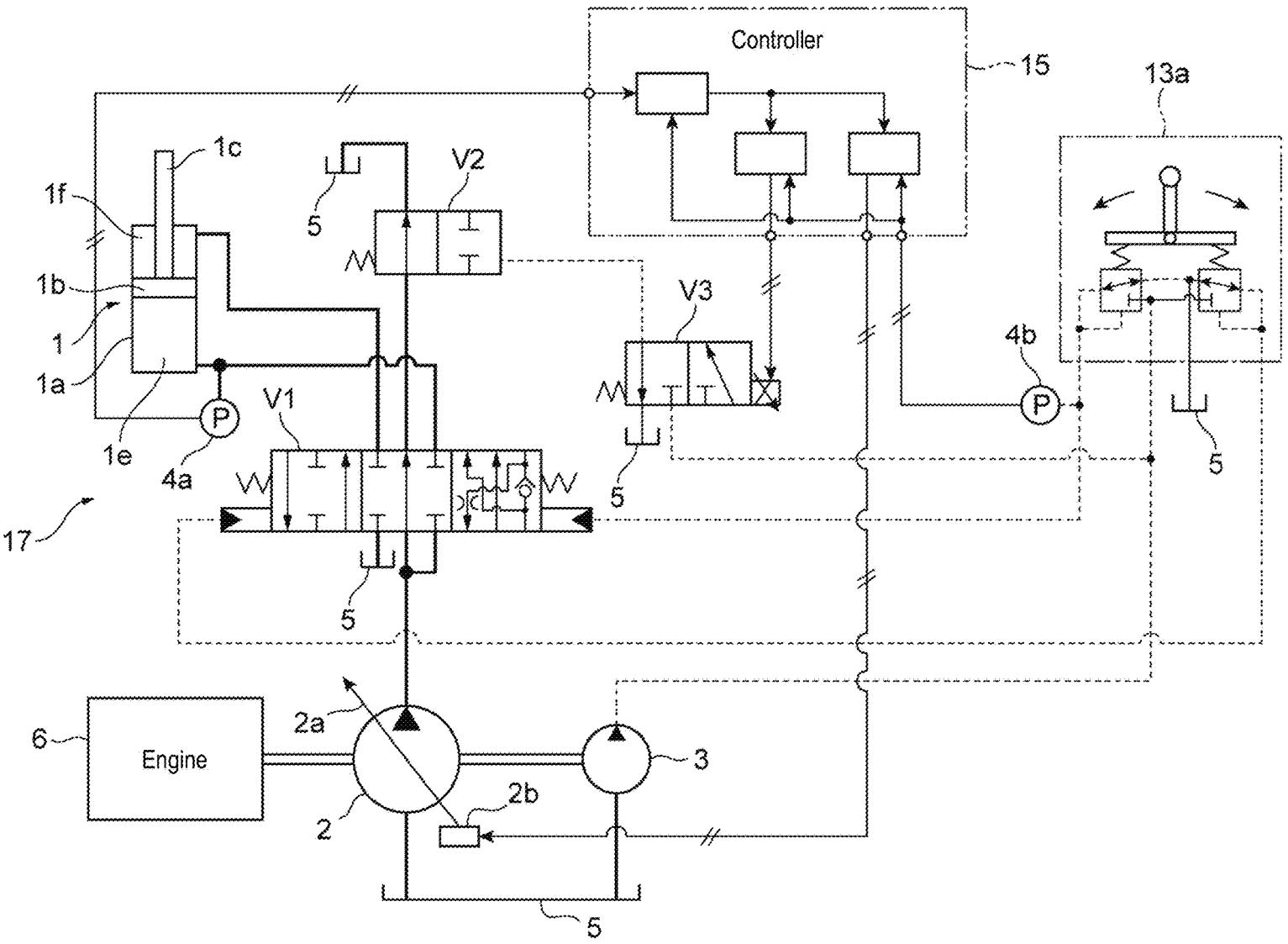
FIG. 3 is a block diagram showing the configuration of a hydraulic drive system of the hydraulic excavator shown in FIG. 1.

FIG. 1 is a side view of a hydraulic excavator equipped with a movement identification device 100 according to Embodiment 1 of the present disclosure. FIG. 2 is a block diagram of the movement identification device 100 mounted on the hydraulic excavator 10 of FIG. 1. FIG. 3 is a block diagram showing an example of the configuration of a hydraulic drive system 17 in the hydraulic excavator 10 of FIG. 1.

As will be described later in detail, the movement identification device 100 of the present embodiment has the following structure as its main features. The movement identification device 100 includes a waveform generation unit 111, a waveform storage unit 121, and a motion identification unit 112. The waveform generation unit 111 generates a force waveform based on the signal of a force sensor that detects the force acting on the construction machine and an attitude waveform based on the signal of an attitude sensor that detects the attitude of the construction machine. The waveform storage unit 121 stores reference waveforms Wr1, Wr2, and Wr3 (see FIG. 5), which are combinations of force waveforms and attitude waveforms corresponding to specific motions of the construction machine. The motion identification unit 112 compares a motion waveform Wm (see FIG. 6), which is a combination of a force waveform and an attitude waveform corresponding to an arbitrary motion of a construction machine, with reference waveforms Wr1, Wr2, and Wr3 stored in the waveform storage unit 121 to identify a specific motion in the arbitrary motion of the construction machine.

The construction machine in which the specific motion is identified by the movement identification device 100 is not particularly limited. However, the construction machine is a hydraulic excavator 10, for example. For instance, the hydraulic excavator 10 is a supersized hydraulic excavator used in mines. The hydraulic excavator 10 shown in FIG. 1 is a backhoe. However, it is needless to say that the construction machine in which the specific motion is identified by the movement identification device 100 can be a loader. The following firstly describes an example of the configuration of the hydraulic excavator 10 that is one example of the construction machine, and then describes the configuration of each unit of the movement identification device 100 of the present embodiment in details.

(Hydraulic Excavator)

In one example, as shown in FIG. 1, the hydraulic excavator 10 includes a lower traveling body 11, an upper slewing body 12, a cab 13, a front working machine 14, and a controller 15. The hydraulic excavator 10 also includes a sensor 18, a transmitter 19A, and a monitor 19B shown in FIG. 2, and an operating lever 13*a* and a hydraulic drive system 17 shown in FIG. 3. The following may describe each part of the hydraulic excavator 10 with reference to a three-dimensional orthogonal coordinate system having X-axis parallel to the front-rear direction of the hydraulic excavator 10, Y axis parallel to the width direction of the hydraulic excavator 10, and Z axis parallel to the height direction of the hydraulic excavator 10.

In one example, the lower traveling body 11 has a traveling device 11*a* with a pair of crawlers in the width direction (Y direction) of the hydraulic excavator 10. In one example, the lower traveling body 11 driven by the hydraulic drive system 17 causes traveling of the hydraulic excavator 10.

The upper slewing body 12 is mounted on the lower traveling body 11 to be able to swivel. In one example, the upper slewing body 12 is driven by a hydraulic motor or an electric motor, which are not shown, and swivels relative to the lower traveling body 11 around a rotary shaft parallel to the height direction (Z direction) of the hydraulic excavator 10. In one example, the upper slewing body 12 houses various devices such as an engine (not shown), a hydraulic pump, and a plurality of valves, described later.

In one example, the cab 13 is a cabin of the hydraulic excavator 10, in which a driver's seat for an operator who manipulates the hydraulic excavator 10 is housed. In one example, the cab 13 is placed above the front portion of the upper slewing body 12 to be adjacent to the front working machine 14.

In one example, the front working machine 14 is provided on the front side of the upper slewing body 12 and driven by the hydraulic drive system 17 and performs works such as digging. In one example, the front working machine 14 has a boom 14*a*, an arm 14*b*, and a bucket 14*c*.

In one example, the boom 14*a* has a proximal end that connects to the upper slewing body 12 via a rotary shaft parallel to the width direction (Y direction) of the hydraulic excavator 10. In one example, the boom 14*a* is driven by an actuator and rotates in a predetermined angular range around the rotary shaft mounted to the upper slewing body 12. In one example, a hydraulic cylinder 1 is used as the actuator to drive the boom 14*a*. The hydraulic cylinder 1 is a hydraulic actuator driven by hydraulic oil supplied.

In one example, the hydraulic cylinder 1 has a cylinder tube 1*a*, a piston 1*b*, and a rod 1*c*. In one example, the hydraulic cylinder 1 is a single-rod hydraulic cylinder having the rod 1*c* protruding to one side of the cylinder tube 1*a*. The hydraulic cylinder 1 that drives the boom 14*a* may be referred to as a boom cylinder 1A, for example.

In the boom cylinder 1A, one end of the cylinder tube 1*a* is connected to an intermediate portion of the boom 14*a* via a rotary shaft parallel to the width direction (Y direction) of the hydraulic excavator 10. The piston 1*b* is housed in the cylinder tube 1*a* and slides in the axial direction of the rod 1*c* along the inner peripheral face of the cylinder tube 1*a*. One end of the rod 1*c* is connected to the piston 1*b* inside the cylinder tube 1*a*. In the boom cylinder 1A, the other end of the rod 1*c* extends externally from the inside of the cylinder tube 1A and is connected to the upper slewing body 12 via a rotary shaft parallel to the width direction (Y direction) of the hydraulic excavator 10.

In one example, the arm 14*b* has a proximal end that connects to the distal end of the boom 14*a* via a rotary shaft parallel to the width direction (Y direction) of the hydraulic excavator 10. In one example, the arm 14*b* is driven by an actuator and rotates in a predetermined angular range around the rotary shaft mounted to the boom 14*a*. In one example, similarly to the boom cylinder 1A, a hydraulic cylinder 1 is used as the actuator to drive the arm 14*b*. The hydraulic cylinder 1 driving the arm 14*b* may be referred to as an arm cylinder 1B, for example.

In the arm cylinder 1B, one end of the cylinder tube 1*a* is connected to an intermediate portion of the boom 14*a* via a rotary shaft parallel to the width direction (Y direction) of the hydraulic excavator 10. In the arm cylinder 1B, the other end of the rod 1*c*, which is on the other side of the end connecting to the piston 1*b*, is connected to the proximal end of the arm 14*b* via a rotary shaft parallel to the width direction (Y direction) of the hydraulic excavator 10. In one example, the rod 1*c* of the arm cylinder 1B is connected to the proximal end side of the arm 14*b* more than the distal end of the boom 14*a*.

In one example, the bucket 14*c* has a proximal end that connects to the distal end of the arm 14*b* via a rotary shaft parallel to the width direction (Y direction) of the hydraulic excavator 10. In one example, the bucket 14*c* is driven by an actuator and rotates in a predetermined angular range around the rotary shaft mounted to the arm 14*b*. In one example, a hydraulic cylinder 1 similar to the boom cylinder 1A is used as the actuator to drive the bucket 14*c*. The hydraulic cylinder 1 that drives the bucket 14*c* may be referred to as a bucket cylinder 1C, for example.

In the bucket cylinder 1C, one end of the cylinder tube 1*a* is connected to the proximal end of the arm 14*b*, for example, via a rotary shaft parallel to the width direction (Y direction) of the hydraulic excavator 10. In the bucket cylinder 1C, the other end of the rod 1*c*, which is on the other side of the end connecting to the piston 1*b*, is connected to the proximal end of the bucket 14*c* via a link, for example. In one example, the link is connected to the rod 1*c* via a rotary shaft parallel to the width direction (Y direction) of the hydraulic excavator 10.

In one example, the controller 15 is housed in the upper slewing body 12, and controls the hydraulic drive system 17 based on the pilot pressure in accordance with the operation with the operating lever 13*a* in the cab 13 and a signal from the sensor 18 mounted to the hydraulic excavator 10. In one example, the controller 15 is a computer unit including a calculation unit 15*a* such as a central processing unit, a memory 15*b* such as RAM and ROM, programs stored in the memory 15*b*, and an input/output unit for inputting/outputting signals.

In one example, the controller 15 is constituting the movement identification device 100 of the present embodiment. The details of the movement identification device 100 are described later. In one example, the movement identification device 100 may be provided separately from the controller 15 that controls the hydraulic drive system 17. In one example, the movement identification device 100 is connected to the sensor 18, the transmitter 19A, and the monitor 19B via a network such as a control area network (CAN).

In one example, the hydraulic drive system 17 includes a hydraulic cylinder 1, a hydraulic pump 2, a pilot pump 3, a bottom-pressure sensor 4*a*, an operating-pressure sensor 4*b*, a hydraulic oil tank 5, and an engine 6. The hydraulic drive system 17 also includes a directional control valve V1, a variable throttle V2, and a variable throttle control valve V3. In one example, the hydraulic excavator 10 is equipped with three hydraulic cylinders 1: a boom cylinder 1A, an arm cylinder 1B and a bucket cylinder 1C. These cylinders 1 have a similar configuration. Therefore FIG. 3 shows one of the hydraulic cylinders 1, and omits the other two hydraulic cylinders 1.

As described above, the hydraulic cylinder 1 has the cylinder tube 1*a*, the piston 1*b*, and the rod 1*c*. The interior of the cylinder tube 1*a* is divided by the piston 1*b* into a bottom-side oil chamber 1*e* located close to the proximal end of the cylinder tube 1*a* and a rod-side oil chamber if located close to the distal end of the cylinder tube 1*a*.

In response to supplying of hydraulic oil into the bottom-side oil chamber 1*e*, the piston 1*b* of the hydraulic cylinder 1 moves to the distal end of the cylinder tube 1*a*. Then the hydraulic oil is discharged from the rod-side oil chamber 1*f*, so that the rod 1*c* extends. In response to supplying of hydraulic oil into the rod-side oil chamber 1*f*, the piston 1*b* of the hydraulic cylinder 1 moves to the proximal end of the cylinder tube 1*a*. Then the hydraulic oil is discharged from the bottom-side oil chamber 1*e*, so that the rod 1*c* contracts.

Specifically, extension of the rod 1*c* of the boom cylinder 1A rotates the boom 14*a* around the rotary shaft at the proximal end of the boom 14*a*, and moves the distal end of the boom 14*a* upward in the height direction (Z direction) of the hydraulic excavator 10. Contraction of the rod 1*c* of the boom cylinder 1A rotates the boom 14*a* around the rotary shaft at the proximal end of the boom 14*a*, and moves the distal end of the boom 14*a* downward in the height direction (Z direction) of the hydraulic excavator 10.

Extension of the rod 1*c* of the arm cylinder 1B rotates the arm 14*b* around the rotary shaft at the proximal end of the arm 14*b*, and moves the distal end of the arm 14*b* downward in the height direction (Z direction) of the hydraulic excavator 10. Contraction of the rod 1*c* of the arm cylinder 1B rotates the arm 14*b* around the rotary shaft at the proximal end of the arm 14*b*, and moves the distal end of the arm 14*b* upward in the height direction (Z direction) of the hydraulic excavator 10.

Extension of the rod 1*c* of the bucket cylinder 1C rotates the bucket 14*c* around the rotary shaft at the proximal end of the bucket 14*c*, and moves the distal end of the bucket 14*c* upward in the height direction (Z direction) of the hydraulic excavator 10. Contraction of the rod 1*c* of the bucket cylinder 1C rotates the arm 14*b* around the rotary shaft at the proximal end of the bucket 14*c*, and moves the distal end of the bucket 14*c* downward in the height direction (Z direction) of the hydraulic excavator 10.

In one example, the hydraulic pump 2 is a variable capacity hydraulic pump of the swash plate type, radial piston type or bent axis type. The hydraulic pump 2 is rotatably driven by the engine 6. In one example, the hydraulic pump 2 has a variable capacity portion 2*a* including a swash plate, a bent axis, or the like, and a variable volume mechanism 2*b* that drives the variable capacity portion 2*a*. The variable volume mechanism 2*b* drives the variable capacity portion 2*a* based on the instruction of the controller 15. This changes the tilt angle of the variable capacity portion 2*a* to increase or decrease the pump capacity of the hydraulic pump 2. The hydraulic pump 2 discharges pressure oil into the discharge pipeline. The discharge pipeline branches into a center bypass pipeline and a branch pipeline at a position upstream of the directional control valve V1.

In one example, the pilot pump 3 is a fixed capacity hydraulic pump. The pilot pump 3 is also rotatably driven by the engine 6. The pilot pump 3, together with the hydraulic oil tank 5, constitutes a pilot pressure-oil source. The pilot pump 3 discharges pilot pressure oil into the pilot pipeline. The pilot pipeline branches into the throttle pilot pipeline for supplying pilot pressure oil to the variable throttle control valve V3 at a position upstream of the operating lever 13*a*.

The directional control valve V1 switches the pressure oil supplied from the hydraulic pump 2 to the hydraulic cylinder 1 to control the supply and discharge of the pressure oil at the hydraulic cylinder 1. The directional control valve V1 includes a hydraulic pilot type directional control valve with 6 ports and 3 positions. The directional control valve V1 is connected to the hydraulic pump 2 via the discharge pipeline, and is connected to the hydraulic oil tank 5 via the center bypass pipeline and the return pipeline. The directional control valve V1 is also connected to the bottom-side oil chamber 1*e* of the hydraulic cylinder 1 via the bottom-side pipeline and to the rod-side oil chamber if of the hydraulic cylinder 1 via the rod-side pipeline.

The variable throttle V2 is located downstream of the directional control valve V1 in the middle of the center bypass pipeline. The variable throttle V2 variably throttles the flow area of the center bypass pipeline at a position downstream of the directional control valve V1. The variable throttle V2 is controlled by the pilot pressure oil supplied from the variable throttle control valve V3. The variable throttle V2 has a smaller flow channel area with a larger pilot pressure from the variable throttle control valve V3, and has a larger flow channel area with a smaller pilot pressure. The pilot pressure of the variable throttle control valve V3 is variably controlled by the controller 15.

The bottom pressure sensor 4*a* detects the pressure of the pressure oil in the bottom-side oil chamber 1*e* of the hydraulic cylinder 1. In one example, the bottom pressure sensor 4*a* detects the pressure of the bottom-side oil chamber 1*e* or the bottom-side pipeline. The bottom pressure sensor 4*a* is connected to the controller 15 via a signal line, and outputs a detection signal corresponding to the detected pressure of the bottom-side oil chamber 1*e* to the controller 15.

The operating pressure sensor 4*b* detects the displacement of the operating lever 13*a*. In one example, the operating pressure sensor 4*b* is placed in the lowering-side pilot pipeline. The operating pressure sensor 4*b* detects the hydraulic pressure in the lowering-side pilot pipeline, that is, the pilot pressure for lowering the boom. The operating pressure sensor 4*b* is connected to the controller 15 via a signal line and detects the pilot pressure of the boom lowering corresponding to the manipulation amount of boom lowering. The operating pressure sensor 4*b* outputs a detection signal corresponding to the pilot pressure of the boom lowering to the controller 15.

The sensor 18 is attached to a part of the hydraulic excavator 10, and detects physical quantities and outputs them to the controller 15. Specifically, the sensor 18 includes a force sensor that detects a force acting on the hydraulic excavator 10, which is a construction machine, and an attitude sensor that detects the attitude of the hydraulic excavator 10, for example. In the example shown in FIG. 2, the sensor 18 includes a hydraulic sensor 18*b* as the force sensor, and an angle sensor 18*a*, an angular rate sensor 18*c*, an acceleration sensor 18*d*, an inclination angle sensor 18*e*, and a not-shown stroke sensor as the attitude sensors. The stroke sensor detects the strokes of the boom cylinder 1A, the arm cylinder 1B, and the bucket cylinder 1C.

In one example, the hydraulic sensor 18*b* detects the hydraulic pressure in the hydraulic cylinder 1 of the hydraulic excavator 10, i.e., the pressure of the hydraulic oil in the bottom-side oil chamber 1*e*. Specifically, the hydraulic sensor 18*b* detects the pressure of the hydraulic oil in the bottom-side oil chamber 1*e* of each of the boom cylinder 1A, the arm cylinder 1B, and the bucket cylinder 1C. The hydraulic sensor 18*b* may be the bottom pressure sensor 4*a* described above, for example. When the lower traveling body 11 and the upper slewing body 12 are driven by a hydraulic motor, the hydraulic sensor 18*b* detects the pressure of the hydraulic oil of the hydraulic motor.

In one example, the angle sensor 18*a* detects the rotating angle of various parts of the construction machine. Specifically, the angle sensor 18*a* detects the rotating angle of the upper slewing body 12 of the hydraulic excavator 10 and of various parts of the front working machine 14, for example. More specifically, this angle sensor 18*a* is placed at each of the rotary shaft of the upper slewing body 12, the rotary shaft at the proximal end of the boom 14*a*, the rotary shaft at the proximal end of the arm 14*b*, and the rotary shaft at the proximal end of the bucket 14*c*. In one example, the angle sensor 18*a* detects the rotation angle of the upper slewing body 12 relative to the lower traveling body 11, the rotation angle of the boom 14*a* relative to the upper slewing body 12, the rotation angle of the arm 14*b* relative to the boom 14*a*, and the rotation angle of the bucket 14*c* relative to the arm 14*b*.

In one example, the angular rate sensor 18*c* is attached to each of the upper slewing body 12, the boom 14*a*, the arm 14*b*, and the bucket 14*c*, and detects the angular rates of the upper slewing body 12, the boom 14*a*, the arm 14*b* and the bucket 14*c*. In one example, the acceleration sensor 18*d* is attached to each of the upper slewing body 12, the boom 14*a*, the arm 14*b*, and the bucket 14*c*, and detects the accelerations of the upper slewing body 12, the boom 14*a*, the arm 14*b* and the bucket 14*c*. In one example, the inclination angle sensor 18*e* is attached to each of the upper slewing body 12, the boom 14*a*, the arm 14*b*, and the bucket 14*c*, and detects the inclination angles of the upper slewing body 12, the boom 14*a*, the arm 14*b* and the bucket 14*c*.

In one example, the transmitter 19A is connected to the controller 15, and transmits information on the motion of the hydraulic excavator 10 and a fatigue index value output from the controller 15 to the outside. The transmitter 19A may transmit identification information on the hydraulic excavator 10. The hydraulic excavator 10 may be equipped with a positioning device such as a global navigation satellite system (GNSS). In this case, the transmitter 19A may transmit the position information on the hydraulic excavator 10.

In one example, the monitor 19B is a display device such as a liquid crystal display device or an organic EL display device placed in the cab 13. In one example, the monitor 19B may include an input device, such as a touch panel. In one example, the monitor 19B displays information on the motion of the hydraulic excavator 10 and a fatigue index value output from the controller 15.

With this configuration, in response to the operation by the operator with the operating lever 13*a*, the directional control valve V1 of the hydraulic excavator 10 moves by the pressure oil from the pilot pump 3, and the pressure oil of the hydraulic pump 2 is guided to the bottom-side oil chamber 1*e* or the rod-side oil chamber if of the hydraulic cylinder 1. As a result, the hydraulic excavator 10 expands or contracts the rods 1*c* of the boom cylinder 1A, the arm cylinder 1B, and the bucket cylinder 1C according to the displacement of the operating lever 13*a* as described above to operate each part of the boom 14*a*, the arm 14*b*, and the bucket 14*c*.

The controller 15 controls the hydraulic motor or the electric motor between the lower traveling body 11 and the upper slewing body 12 in accordance with the operation signal from the operating lever 13*a*. As a result, the hydraulic excavator 10 swivels the upper slewing body 12 relative to the lower traveling body 11 in accordance with the displacement of the operating lever 13*a*.

(Movement Identification Device)

Next, the following describes the structure of various units of the movement identification device 100 of the present embodiment in details. In one example, the movement identification device 100 of the present embodiment includes a motion storage unit 122 in addition to the waveform generation unit 111, the motion identification unit 112, and the waveform storage unit 121 as stated above. In one example, the movement identification device 100 of the present embodiment also includes a stress calculation unit 113, a damage degree calculation unit 114, and an index value calculation unit 115. In one example, the movement identification device 100 of the present embodiment also includes a calculation expression storage unit 123, a S-N curve storage unit 124, and an index value storage unit 125.

As shown in FIGS. 1 and 2, the movement identification device 100 of the present embodiment may be configured with the controller 15 mounted on the hydraulic excavator 10. The controller 15 does not necessarily have to be mounted on the construction machine, and may be provided outside the construction machine. Specifically, the controller 15 may include an information terminal that can receive information of the sensor 18 via a transmitter 19A from the hydraulic excavator 10, for example.

As described above, the waveform generation unit 111 generates a force waveform based on the signal of a force sensor that detects the force acting on the construction machine and an attitude waveform based on the signal of an attitude sensor that detects the attitude of the construction machine. Specifically, the waveform generation unit 111 generates a force waveform, which is the time-series data of pressure, based on the signal of the hydraulic sensor 18*b* that detects the pressure acting on the hydraulic oil inside the hydraulic cylinder 1 of the hydraulic excavator 10, for example. The waveform generation unit 111 also generates an attitude waveform, which is the time-series data of the rotating angles of various part of the hydraulic excavator 10, based on the signal of the angle sensor 18*a* that detects the rotating angle of each part, for example.

The waveform generation unit 111 may generate a force waveform and an attitude waveform based on the signal of a sensor other than the angle sensor 18*a* and the hydraulic sensor 18*b* included in the sensor 18. The waveform generation unit 111 may also perform appropriate pre-processing on the generated force waveform and attitude waveform, such as noise removal and gain adjustment.

Figure 5:
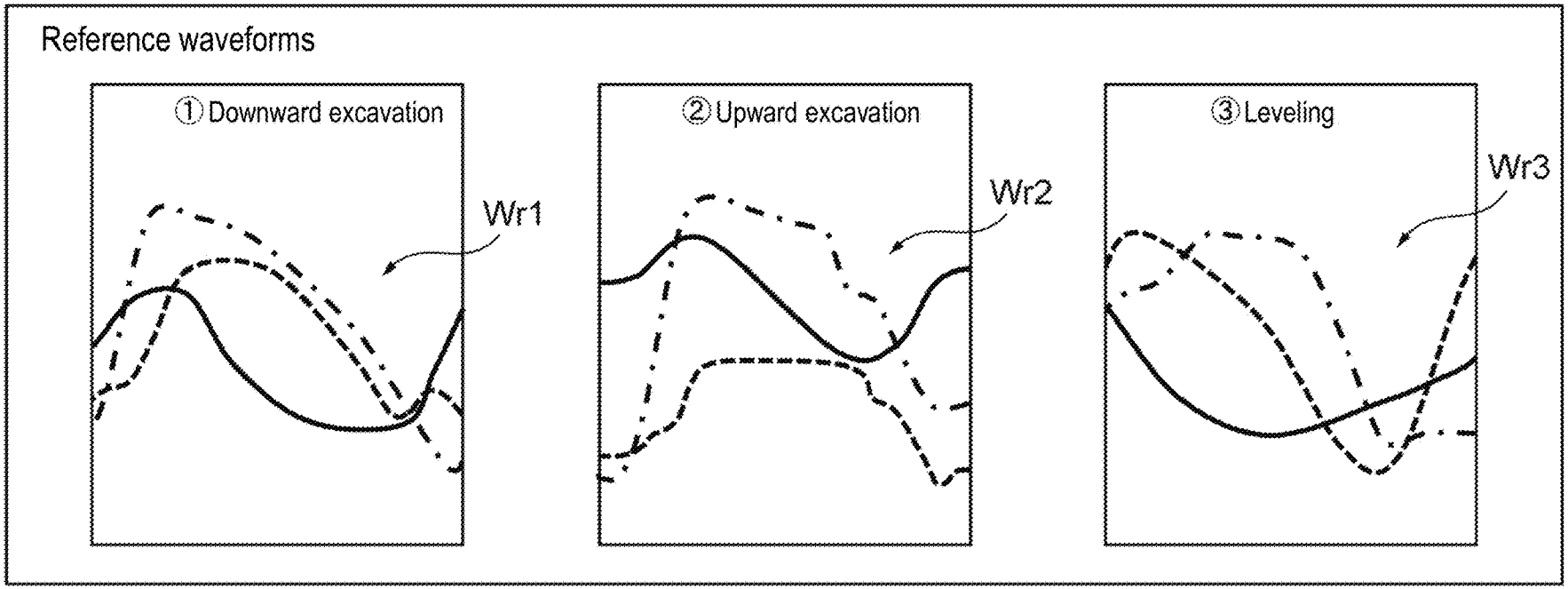
FIG. 5 shows one example of reference waveforms stored in a waveform storage unit of the movement identification device of FIG. 2.

FIG. 5 shows one example of the reference waveforms Wr1, Wr2, and Wr3 stored in the waveform storage unit 121. In FIG. 5, the three waveforms with different line types (solid, dashed, and dashed-dotted) are waveform data on force waveforms and attitude waveforms based on signals from a plurality of different sensors, including at least one force sensor and at least one attitude sensor. FIG. 5 shows one reference waveform Wr1, Wr2, or Wr3, which includes a plurality of pieces of waveform data that are combinations of force waveforms and attitude waveforms, for each motion of the hydraulic excavator 10. Note that, in reality, the reference waveform of each motion of the hydraulic excavator 10 includes a plurality of reference waveforms corresponding to various joints and various components of the hydraulic excavator 10, for example.

As described above, the waveform storage unit 121 stores reference waveforms Wr1, Wr2, and Wr3, which are combinations of force waveforms and attitude waveforms corresponding to specific motions of the construction machine. In one example, the waveform storage unit 121 stores a plurality of reference waveforms Wr1, Wr2, and Wr3 corresponding to a plurality of different specific movements. Specifically, the waveform storage unit 121 stores the reference waveforms Wr1, Wr2, and Wr3 that are the reference waveforms for each motion of the hydraulic excavator 10, including the reference waveform Wr1 corresponding to the downward excavation, the reference waveform Wr2 corresponding to the upward excavation, and the reference waveform Wr3 corresponding to the leveling.

The reference waveform Wr1 of the downward excavation, indicated by the circled number 1 in FIG. 5, is the reference waveform of the motion in which the hydraulic excavator 10 excavates below the cab 13, for example. The reference waveform Wr2 of the upward excavation, indicated by the circled number 2 in FIG. 5, is the reference waveform of the motion in which the hydraulic excavator 10 excavates above the cab 13, for example. The reference waveform Wr3 of the leveling, indicated by the circled number 3 in FIG. 5, is the reference waveform of the motion in which the hydraulic excavator 10 levels earth and crushed stone to be flat, for example. The motions corresponding to the reference waveforms stored in the waveform storage unit 121 are not particularly limited, and the waveform storage unit 121 can store any number of reference waveforms corresponding to any motions.

Figure 6:
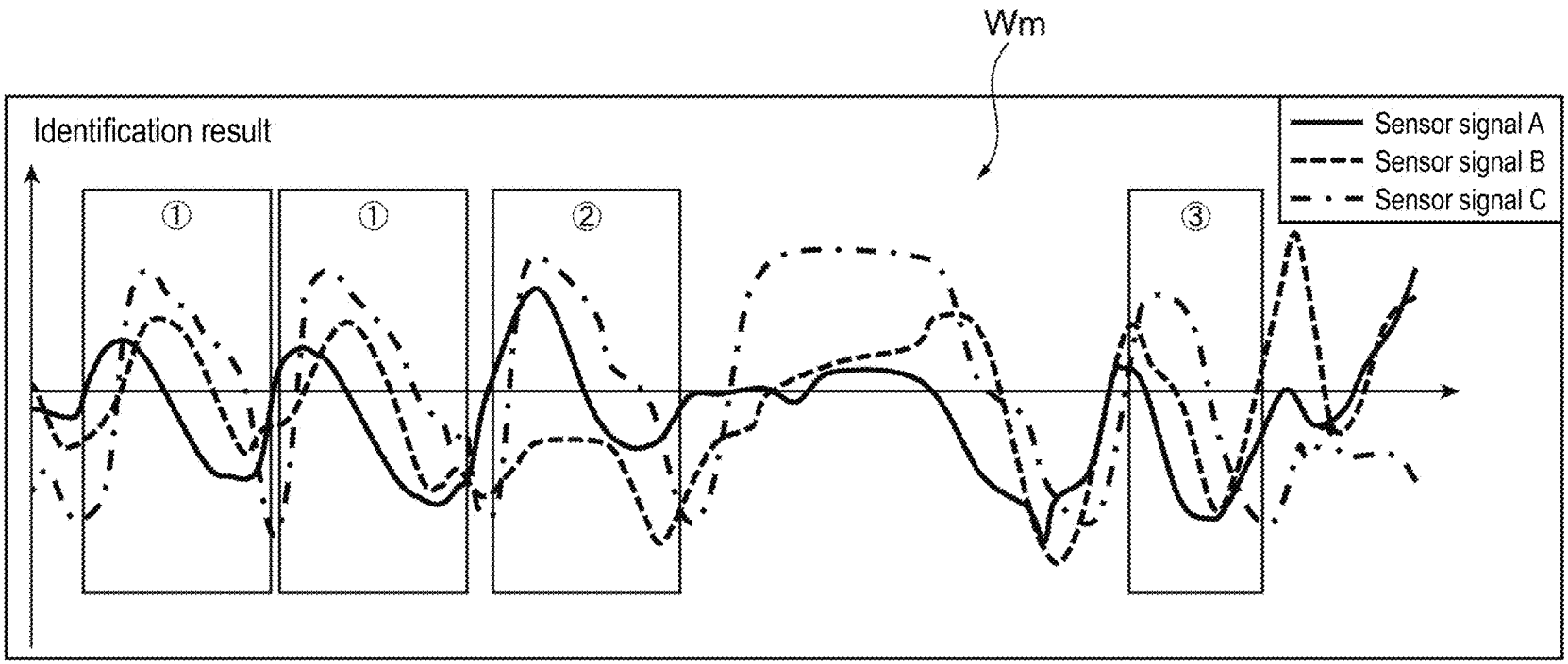
FIG. 6 shows one example of the identification of specific motions by the motion identification unit of the movement identification device of FIG. 2.

FIG. 6 shows one example of the identification result of specific motions by the motion identification unit 112. In FIG. 6, the combination of the waveforms of sensor signal A shown by the solid line, the sensor signal B shown by the broken line, and the sensor signal C shown by the dashed-dotted line is the motion waveform Wm when the hydraulic excavator 10 moves. The motion waveform Wm is a combination of at least one force waveform and at least one attitude waveform, corresponding to an arbitrary motion when the hydraulic excavator 10 moves.

As described above, the motion identification unit 112 compares a motion waveform Wm, which is a combination of a force waveform and an attitude waveform corresponding to a certain motion of a construction machine, with reference waveforms Wr1, Wr2, and Wr3 stored in the waveform storage unit 121 to identify a specific motion in the certain motion. Specifically, the motion identification unit 112 compares the motion waveform Wm corresponding to a certain motion of the hydraulic excavator 10 with the reference waveforms Wr1, Wr2, and Wr3 of the specific motions shown by the circled numbers 1 to 3 in FIG. 5, to identify a specific motion included in the arbitrary motion.

In one example, the motion identification unit 112 performs pattern matching of a part of the motion waveform Wm and the reference waveforms Wr1, Wr2, and Wr3 sequentially to identify the specific motions included in the motion waveform Wm, i.e., the motions of the circled numbers 1 to 3 shown in FIG. 5. In the example shown in FIG. 6, the motion identification unit 112 identifies two times of the downward excavation indicated by the circled number 1, one time of the upward excavation indicated by the circled number 2, and one time of the leveling indicated by the circled number 3, from the motion waveform Wm of the hydraulic excavator 10 for a predetermined period.

In one example, the motion identification unit 112 outputs specific motions identified from the motion waveform Wm, including downward excavation, upward excavation, and leveling, to the monitor 19B and the motion storage unit 122. In one example, the motion identification unit 112 obtains the operating time of the hydraulic excavator 10 and the number of specific motions identified during that operating time based on the motion waveform Wm, and outputs them to the monitor 19B and the motion storage unit 122. In one example, the motion identification unit 122 obtains the number of the specific motions per unit time based on the motion waveform Wm, and outputs it to the monitor 19B and the motion storage unit 122.

In one example, the motion storage unit 122 stores specific motions of the hydraulic excavator 10 output from the motion identification unit 112. In one example, the motion storage unit 122 stores the operating time of the hydraulic excavator 10 and the number of specific motions identified during that operating time output from the motion identification unit 112. In one example, the motion storage unit 122 stores the number of specific motions per unit time output from the motion identification unit 112.

The stress calculation unit 113 calculates stress acting on a plurality of portions of the construction machine based on the outputs of the force sensor that detects a force acting on the construction machine and an attitude sensor that detects the attitude of the construction machine. Specifically, in one example, the stress calculation section 113 calculates the stress acting on a plurality of portions of each of the boom 14*a*, the arm 14*b*, and the bucket 14*c* of the hydraulic excavator 10 based on the outputs of the sensors 18 attached to the boom 14*a*, the arm 14*b*, and the bucket 14*c*. Although not particularly limited, tens to hundreds of portions may be set for each component.

An example of the stress calculation method by the stress calculation unit 113 is as follows. As shown in FIG. 2, the stress calculation unit 113 calculates the stress acting on a plurality of portions of each component constituting the hydraulic excavator 10 using a stress calculation expression stored in advance in the calculation expression storage unit 123, for example. The stress calculation expression, for example, represents the relationship between the outputs of the sensor 18 and the stress acting on a plurality of portions of the components of the hydraulic excavator 10. The stress calculation expression is obtained in advance for each portion of the components of the hydraulic excavator 10 using a multiple regression equation or a regression equation using machine learning, and is stored in the calculation expression storage unit 123.

An example of the stress calculation equations is shown in the following expressions (1) to (3). In expressions (1) to (3), $\sigma_1$, $\sigma_2$, . . . denote stresses acting on a plurality of portions of the components of the hydraulic excavator 10. In expressions (1) to (3), $s_1$, $s_2$, . . . denote the outputs of the sensors 18, M, N and A are constants based on the characteristics of these portions, and t denotes the time. Thus, the stress calculation equations may be obtained in advance, whereby the stress acting on each of many portions of the components of the hydraulic excavator 10 and the time-history stress waveforms can be easily obtained by simple calculations based on the output of the sensor 18.

[Mathematical 1]

$$\begin{bmatrix} \sigma_1 \\ \sigma_2 \\ \vdots \end{bmatrix} = M \begin{bmatrix} s_1 \\ s_2 \\ \vdots \end{bmatrix} + A \tag{1}$$

[Mathematical 2]

$$\begin{bmatrix} \sigma_1 \\ \sigma_2 \\ \vdots \end{bmatrix} = M_1 \begin{bmatrix} s_1 \\ s_2 \\ \vdots \end{bmatrix} + M_2 \begin{bmatrix} s_1^2 \\ s_2^2 \\ \vdots \end{bmatrix} + M_3 \begin{bmatrix} s_1^3 \\ s_2^3 \\ \vdots \end{bmatrix} + \ldots + A \tag{2}$$

[Mathematical 3]

$$\begin{bmatrix} \sigma_{1t} \\ \sigma_{2t} \\ \vdots \end{bmatrix} = M_t \begin{bmatrix} s_{1t} \\ s_{2t} \\ \vdots \end{bmatrix} + \sum_{i=1}^{t-1} N_i \begin{bmatrix} \sigma_{1i} \\ \sigma_{2i} \\ \vdots \end{bmatrix} + \sum_{i=1}^{t-1} M_i \begin{bmatrix} s_{1t} \\ s_{2t} \\ \vdots \end{bmatrix} \tag{3}$$

The damage degree calculation unit 114 calculates the cumulative damage degree at each portion based on the stress acting on the portion calculated by the stress calculation unit 113. Specifically, the damage degree calculation unit 114 calculates the cumulative damage degree D at each portion of the components based on the time-history stress waveform acting on the portion of the components of the hydraulic excavator 10 and the S-N curve of the stress amplitude and the number of repetitions that is stored in advance in the S-N curve storage unit 124. In one example, the cumulative damage degree can be calculated by the Miner's law shown in expression (4) below or the modified Miner's law, following the frequency analysis of the time-history stress waveform by the range-pair counting, the peak valley method, or the rainflow counting.

[Mathematical 4]

$$D = \sum_i \frac{n_i}{N_i} \tag{4}$$

The index value calculation unit 115 calculates a fatigue index value, which is a weighted value of the cumulative damage degree calculated by the damage degree calculation unit 114, for each portion of the components of the hydraulic excavator 10. In one example, the fatigue index value is obtained by assigning the weighting according to the usage environment, material properties, and other factors for each component and each portion of the hydraulic excavators 10 to the cumulative damage degree calculated for each portion of the components of the hydraulic excavator 10. The fatigue index value indicates the degree of fatigue and is represented by an integer increasing from 1, for example.

An example of the calculation equation for fatigue index value is shown in the following expression (5). In expression (5), $i_1$, $i_2$, . . . denote fatigue index values of each portion of the components, a denotes an arbitrary coefficient, and $w_{a1}$, $w_{a2}$, . . . and $w_{b1}$, $w_{b2}$, . . . and $b_1$, $b_2$, . . . denote numerical values for weighting specific to each portion of the components of the hydraulic excavator 10. Further, $d_1$, $d_2$, . . . denote the cumulative damage degree of each portion of the components.

[Mathematical 5]

$$\begin{bmatrix} i_1 \\ i_2 \\ \vdots \end{bmatrix} = a \begin{bmatrix} w_{a1} & 0 & \ldots \\ 0 & w_{a2} & \ldots \\ \vdots & \vdots & \ddots \end{bmatrix} \begin{bmatrix} w_{b1} & 0 & \ldots \\ 0 & w_{b2} & \ldots \\ \vdots & \vdots & \ddots \end{bmatrix} \ldots \begin{bmatrix} d_1 \\ d_2 \\ \vdots \end{bmatrix} + \begin{bmatrix} b_1 \\ b_2 \\ \vdots \end{bmatrix} \tag{5}$$

The weightings $w_{a1}$, $w_{a2}$, . . . , $w_{b1}$, $w_{b2}$, . . . and $b_1$, $b_2$, . . . according to the operating environment, material properties, and other conditions for each hydraulic excavator 10, each component, and each portion are stored in the memory 15*b*, together with the calculation expression such as expression (5). In one example, a user or a seller of the hydraulic excavator 10 can freely change these weightings by inputting information to the input device of the monitor 19B or the input device of an information terminal (not shown) according to the individual request or environment. In one example, the index value calculation unit 115 uses the calculation expression as shown in expression (5), for example, to calculate the fatigue index values $i_1$, $i_2$, . . . from the cumulative damage degree $d_1$, $d_2$, . . . calculated by the damage degree calculation unit 114.

The movement identification device 100 of the present embodiment may further include a comparison unit that compares a degree of fatigue based on time series data of the fatigue index value. In one example, the comparison unit may be part of the index value calculation unit 115. In other words, the index value calculation unit 115 may also function as the comparison unit that compares a degree of fatigue based on time series data of the fatigue index value. The index value calculation unit 115 functioning as the comparison unit outputs the comparison result of the degree of fatigue to the monitor 19B and the index value storage unit 125, for example.

Figure 4:
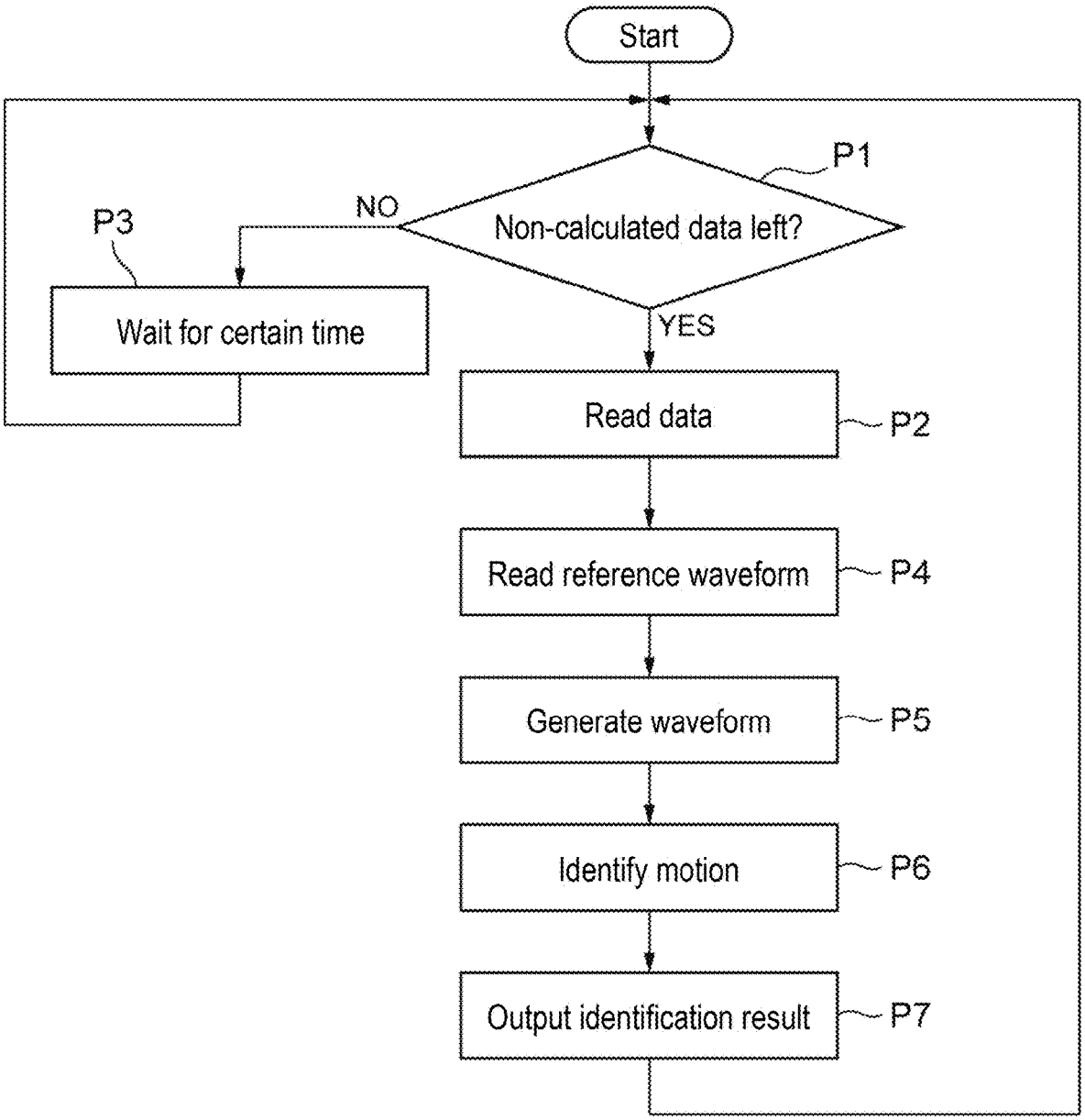
FIG. 4 is a flowchart showing an example of the processing by the movement identification device of FIG. 2.

Referring to FIGS. 4 to 8, the following describes the action of the movement identification device 100 of the present embodiment. FIG. 4 is a flowchart showing an example of the processing by the movement identification device 100 of FIG. 2.

In one example, in response to activation of the hydraulic excavator 10 by the operator, the movement identification device 100 starts generating a force waveform and an attitude waveform by the waveform generation unit 111 and calculating the fatigue index value by the stress calculation unit 113. First, the waveform generation unit 111 and the stress calculation unit 113 perform determination process P1 as to whether or not the data acquired from the sensor 18 includes not-calculated data. Specifically, in the determination process P1, the waveform generation unit 111 and the stress calculation unit 113 search for the data acquired from the sensor 18. If there is new data that has not been processed in the past (YES), these units perform process P2 to read the data. In the determination process P1, if there is no new data that has not been processed in the past (NO), the waveform generation unit 111 and the stress calculation unit 113 perform process P3 that waits for a certain period of time, and then return to the determination process P1.

After reading data in the process P2, the waveform generation unit 111 performs process P4 to read reference waveforms Wr1, Wr2, and Wr3 as shown in FIG. 5 from the waveform storage unit 121. Following the process P2 of reading the data, the stress calculation unit 113 performs the process of selecting one evaluation point that has not undergone calculation from the plurality of evaluation points corresponding to the plurality of portions of the components of the hydraulic excavator 10. For this process, all the evaluation points have individual numbers assigned, and the stress calculation unit 113 selects the not-calculated evaluation points in ascending order one by one starting from the evaluation point with the smallest number.

After the end of the process P4, the waveform generation unit 111 generates a force waveform and an attitude waveform based on the data read in the process P2, and performs process P5 to generate a motion waveform Wm corresponding to an arbitrary motion of the hydraulic excavator 10. The stress calculation unit 113 uses the above-described calculation expressions (1) to (3) and the data read at the process P2, for example, to perform process that calculates a time-series stress waveform at the selected evaluation point, that is, a time-history stress waveform.

After that, the motion identification unit 112 compares the motion waveform Wm generated in the process P5 with the reference waveforms Wr1, Wr2, and Wr3 read in the process P4. Then, as shown in FIGS. 5 and 6, the motion identification unit 112 performs process P6 to identify a specific motion of the hydraulic excavator 10 from the motion waveform Wm corresponding to the arbitrary motion of the hydraulic excavator 10. Examples of the specific motion include downward excavation of the circled number 1, upward excavation of the circled number 2, and leveling of the circled number 3.

The damage degree calculation unit 114 performs the process that calculates the cumulative damage degree at the selected evaluation point based on the time-history stress waveform calculated by the stress calculation unit 113 as described above. The index value calculation unit 115 then performs the process that calculates the fatigue index value of the selected evaluation point using the cumulative damage degree calculated by the damage degree calculation unit 114 as described above.

After the end of the process P6, in one example, the motion identification unit 112 performs process P7 that outputs the specific motion identified from the motion waveform Wm to the monitor 19B and the motion storage unit 122. In one example, in process P7, the motion identification unit 112 outputs the specific motion as well as the operating time of the hydraulic excavator 10, the number of the specific motions identified during that operating time, and the number of the specific motions per unit time to the monitor 19B and the motion storage unit 122. In one example, the determination process P1 to the process P7 can be repeated from turning-on of the start switch of the hydraulic excavator 10 to turning-off of the switch. Tables 1 and 2 below show an example of the information displayed on the monitor 19B. When the machine itself is machine A, only the information on machine A is displayed on its own monitor 19B. When the machine can obtain information on other machines, the monitor can display information of machines A to D as shown below. The information on each machine may be transmitted to an external management device, for example, by the transmitter 19B, and the operator can confirm the status of a plurality of hydraulic excavators as shown in Tables 1 and 2 below.

TABLE 1

| LIFE INFORMATION | MACHINE A | MACHINE B | MACHINE C | MACHINE D |
|---|---|---|---|---|
| OPERATING TIME[HR] | 15,890 | 1,439 | 8,593 | 17,582 |
| DOWNWARD EXCAVATION [TIMES] | 762,720 | 30,219 | 154,674 | 316,476 |
| UPWARD EXCAVATION [TIMES] | 31,780 | 2,878 | 42,965 | 492,296 |
| LEVELING [TIMES] | 15,890 | 0 | 51,558 | 228,566 |

TABLE 2

| MOTIONS | MACHINE A | MACHINE B | MACHINE C | MACHINE D |
|---|---|---|---|---|
| DOWNWARD EXCAVATION [TIMES/HR] | 48 | 21 | 18 | 18 |
| UPWARD EXCAVATION [TIMES/HR] | 2 | 2 | 5 | 28 |
| LEVELING [TIMES/HR] | 1 | 0 | 6 | 13 |

In this way, the movement identification device of the present embodiment identifies a specific motion from an arbitrary motion of the hydraulic excavator 10 to clarify the unbalanced state in motion of each hydraulic excavator 10. In addition, if the number of specific tasks exceeds a specific number or the number of specific motions per short period of time exceeds a threshold, the device can issue an alarm, for example, to recommend inspection of the machine.

The index value calculation unit 115 determines whether or not the fatigue index value has been calculated for all the evaluation points. If the result of the determination shows that the calculation of all the evaluation points has not been completed, the index value calculation unit 115 returns to the process that selects one of the not-calculated evaluation points. If the result of the determination shows that the calculation of all the evaluation points is completed, the index value calculation unit 115 determines whether the fatigue index value exceeds a threshold of each evaluation point stored in the memory 15*b*, for example.

In this determination, the index value calculation unit 115 may compare the fatigue index value of each of the evaluation points with the threshold of the evaluation point, or may compare the fatigue index value of each of a plurality of evaluation points selected in advance with the threshold of the selected evaluation point. If the result of the determination shows that the fatigue index value exceeds the threshold at any evaluation point, then the index value calculation unit 115 may send an alarm recommending inspection of the portion corresponding to the evaluation point to the information terminal via the transmitter 19A or may display it on the monitor 19B, for example.

After that, the index value calculation unit 115 performs the process of outputting the fatigue index values of all the evaluation points to the monitor 19B and the memory 15*b*, and the procedure returns to the determination process P1. In one example, the determination process P1 to the process of outputting the fatigue index values can be repeated from turning-on of the start switch of the hydraulic excavator 10 to turning-off of the switch.

As described above, the movement identification device 100 of the present embodiment includes the waveform generation unit 111, the waveform storage unit 121, and the motion identification unit 112. The waveform generation unit 111 generates a force waveform based on the signal of a force sensor that detects the force acting on the construction machine and an attitude waveform based on the signal of an attitude sensor that detects the attitude of the construction machine. The waveform storage unit 121 stores reference waveforms Wr1, Wr2, and Wr3, which are combinations of force waveforms and attitude waveforms corresponding to specific motions of the construction machine. The motion identification unit 112 compares a motion waveform Wm, which is a combination of a force waveform and an attitude waveform corresponding to an arbitrary motion of a construction machine, with reference waveforms Wr1, Wr2, and Wr3 stored in the waveform storage unit 121 to identify a specific motion in the arbitrary motion of the hydraulic excavator 10.

This configuration enables identification of the type of a motion of the construction machine based on the output of the sensor 18 attached to the construction machine with higher accuracy than the conventional technology. Thus, the present embodiment provides the movement identification device 100 capable of identifying a specific motion of the hydraulic excavator 10, such as downward excavation, upward excavation, and leveling, based on the outputs of the angle sensor 18*a* and the hydraulic sensor 18*b* of the hydraulic excavator 10 from an arbitrary motion of the hydraulic excavator 10 with higher accuracy than conventional technology.

Specifically, the conventional excavator support device as described above is configured so that the management device estimates the work content of the excavator based on the time history of the attitude of the attachment. Therefore, the management device might erroneously estimate the work content based on the time history of the attachment attitude similar to the work content of the excavator, even when the excavator is not actually performing that work.

In contrast, the movement identification device 100 of the present embodiment is configured so that the waveform generation unit 111 generates a force waveform based on the signal of the hydraulic sensor 18*b* that detects the hydraulic pressure acting on the hydraulic cylinder 1 of the hydraulic excavator 10 and an attitude waveform based on the signal of the angle sensor 18*a* that detects the rotation angle of each part of the hydraulic excavator 10. The waveform storage unit 121 stores reference waveforms Wr1, Wr2, and Wr3, which are combinations of force waveforms and attitude waveforms corresponding to specific motions of the hydraulic excavator 10. The motion identification unit 112 compares a motion waveform Wm, which is a combination of a force waveform and an attitude waveform corresponding to an arbitrary motion of the hydraulic excavator 10, with the reference waveforms Wr1, Wr2, and Wr3 stored in the waveform storage unit 121 to identify a specific motion in the arbitrary motion of the hydraulic excavator 10.

With this configuration, when the hydraulic excavator 10 is not performing a specific motion, the force waveform based on the signal of the hydraulic sensor 18*b* included in the motion waveform Wm of the hydraulic excavator 10 will be different from the force waveform included in the reference waveforms Wr1, Wr2, and Wr3. When the hydraulic excavator 10 is not performing a specific motion, the attitude waveform based on the signal of the angle sensor 18*a* included in the motion waveform Wm may be similar to or the same as the attitude waveform included in the reference waveforms Wr1, Wr2, and Wr3. Even in this case, the present embodiment prevents erroneous identification of a specific motion. Thus, the movement identification device 100 of the present embodiment is capable of identifying a type of a motion of the hydraulic excavator 10 based on the outputs of the sensor 18 attached to the hydraulic excavator 10 with higher accuracy than conventional technology.

The movement identification device 100 of the present embodiment is configured so that the waveform storage unit 121 stores a plurality of different reference waveforms Wr1, Wr2, and Wr3 corresponding to a plurality of different specific motions. This configuration allows the movement identification device to identify a plurality of specific motions corresponding to the plurality of reference waveforms Wr1, Wr2, and Wr3 from an arbitrary motion of the hydraulic excavator 10. Simply storing a reference waveform corresponding to a new specific motion in the waveform storage unit 121 allows the movement identification device to easily identify the new specific motion from an arbitrary motion of the hydraulic excavator 10.

In the movement identification device 100 of the present embodiment, the force sensor that detects a force acting on the construction machine is the hydraulic sensor 18*b* that measures the hydraulic pressure in the hydraulic cylinder 1 of the construction machine. With this configuration, the bottom pressure sensor 4*a* conventionally provided in the hydraulic drive system 17 of the hydraulic excavator 10 can be used as the hydraulic sensor 18*b*, for example. In this way, the present embodiment does not require the installment of a sensor such as a strain gauge just for measuring the force. The movement identification device 100 therefore can be easily used for a construction machine, such as the hydraulic excavator 10. Further, the stress acting on each part of the hydraulic excavator 10 can be calculated more accurately based on the output of the hydraulic sensor 18*b*.

In the movement identification device 100 of the present embodiment, the attitude sensor that detects the attitude of the construction machine is the angle sensor 18*a* that detects the rotation angle of each part of the construction machine.

Specifically, the attitude sensor that detects the attitude of the hydraulic excavator 10 in the movement identification device 100 of the present embodiment is the angle sensor 18*a* that detects the relative rotation angles between the lower traveling body 11 and the upper slewing body 12, the upper slewing body 12 and the boom 14*a*, the boom 14*a* and the arm 14*b*, and the arm 14*b* and the bucket 14*c*.

With this configuration, the angle sensor 18*a* conventionally provided in the hydraulic excavator 10 can be used as the attitude sensor, for example. The movement identification device 100 therefore can be easily used for a construction machine, such as the hydraulic excavator 10. Further, the stress acting on each part of the hydraulic excavator 10 can be calculated more accurately based on the output of the angle sensor 18*a*.

In the movement identification device 100 of the present embodiment, the attitude sensor that detects the attitude of the construction machine includes the acceleration sensor 18*d*. This configuration enables measurement of the attitude of the construction machine more correctly and identification of the type of a motion of the construction machine more accurately.

The movement identification device 100 of the present embodiment includes the stress calculation unit 113, the damage degree calculation unit 114, and the index value calculation unit 115. The stress calculation unit 113 calculates stress acting on a plurality of portions of the construction machine based on the outputs of the force sensor and the attitude sensor. The damage degree calculation unit 114 calculates the cumulative damage degree of each portion of the construction machine based on the stress calculated by the stress calculation unit 113. The index value calculation unit 115 calculates a fatigue index value, which is a weighted value of the cumulative damage degree, for each portion.

This configuration enables the movement identification device 100 to manage the fatigue of each portion of the construction machine more accurately than the conventional systems, according to the conditions specific to each construction machine, each component of the construction machine, and each of a plurality of portions of the components, for example.

Specifically, the cumulative damage degree directly used in the conventional excavator support device is based on the linear cumulative damage rule, which is an empirical rule, and assumes that the object will undergo fatigue fracture when the cumulative damage degree reaches 1. The cumulative damage degree, however, is a value that inherently includes fluctuations, and in reality, an object may undergo fatigue failure before the cumulative damage degree reaches 1, or the object may not undergo fatigue failure even if the cumulative damage degree exceeds 1. The conventional excavator support device, which uses the cumulative damage degree as it as, may fail to appropriately set the inspection timing for each excavator part.

In contrast, the movement identification device 100 of the present embodiment is configured so that the index value calculation unit 115 calculates a fatigue index value, which is a weighted value of the cumulative damage degree, for each portion. This configuration enables the management of fatigue at each hydraulic excavator 10 and at the upper slewing body 12, the boom 14*a*, the arm 14*b*, the bucket 14*c*, and a plurality of portions of these components of the hydraulic excavator 10 according to their specific conditions.

Specifically, the weightings may be assigned to the cumulative damage degree so that, among the components of the hydraulic excavator 10, a component having a high risk of damage or a specific portion of such a component has a higher fatigue index value than the fatigue index values of other components or other portions, for example. Therefore, using the fatigue index values calculated by the index value calculation unit 115 enables the fatigue management of the components and specific portions having a high risk of damage more accurately and safely.

Figure 7A:
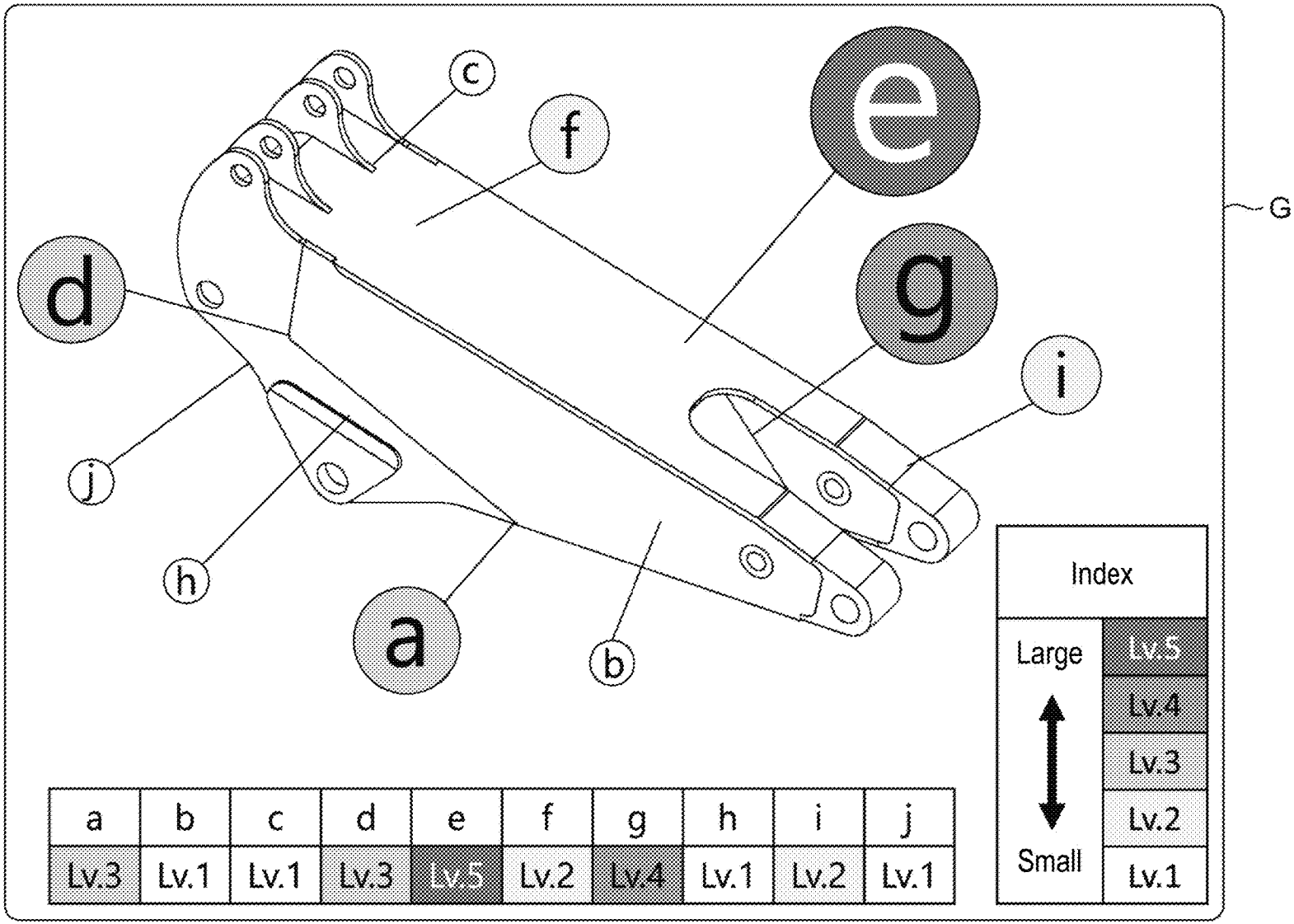
FIG. 7A shows an example of the image displayed on the monitor in the fatigue management system shown in FIG. 1.
Figure 7B:
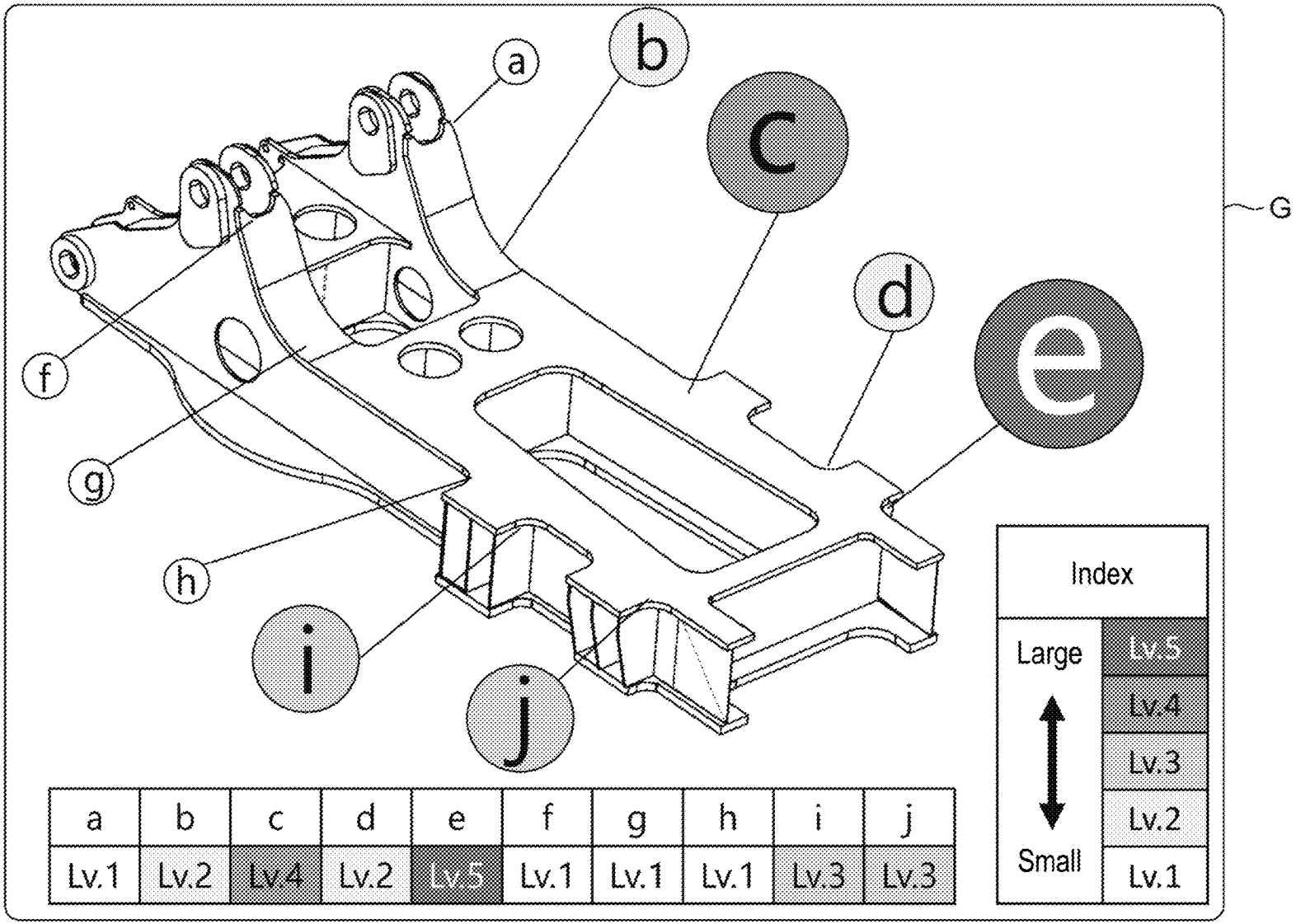
FIG. 7B shows an example of the image displayed on the monitor in the fatigue management system shown in FIG. 1.
Figure 7C:
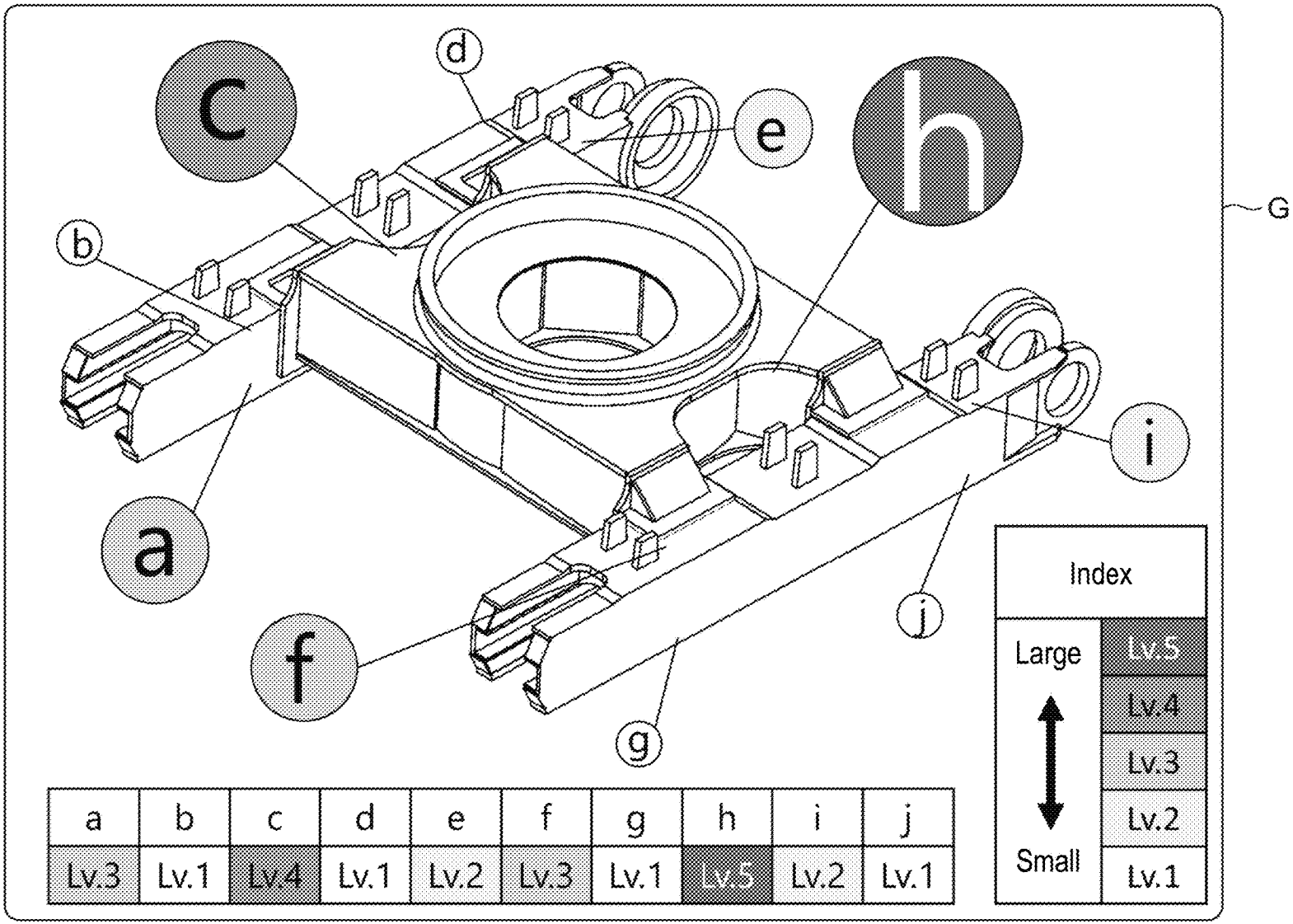
FIG. 7C shows an example of the image displayed on the monitor in the fatigue management system shown in FIG. 1.

FIGS. 7A to 7C show an example of the images G displayed on the monitor 19B of the movement identification device 100 shown in FIG. 2. The movement identification device 100 of the present embodiment may display the fatigue index values calculated by the index value calculation unit 115 on the monitor 19B.

FIG. 7A shows an example of the image G displayed on the monitor 19B, associating each of a plurality of portions of the arm 14*b* of the hydraulic excavator 10 with their corresponding fatigue index values. In this image G, ten arbitrary points from point a to point j are selected from the plurality of portions of the arm 14*b*. The fatigue index values are indexes and are represented by an integer increasing from 1, for example. In one example, the fatigue index values are displayed as five-level "index" from level Lv.1 to level Lv.5 for each of the portions of points a to j of the arm 14*b*. In the five levels, level Lv.1 has the smallest fatigue index value, and level Lv.5 has the largest fatigue index value.

In the example shown in FIG. 7A, the image G shows the image of the arm 14*b*, lead lines drawn from the portions of points a to j of the arm 14*b*, and circles having letters inside to indicate the portions that are displayed at the tip ends of the lead lines. In one example, these circles are displayed with a diameter and a color corresponding to the level of the index. Specifically, for instance, the circle has a large diameter for a portion having high index level and fatigue index value, and has a small diameter for a portion having low index level and fatigue index value. For instance, the circle and the cell in the table are colored dark for a portion having high index level and fatigue index value, and are colored light for a portion having low index level and fatigue index value. This provides a visual indication of the fatigue index values for various portions of the components of the hydraulic excavator 10.

FIG. 7B shows an example of the image G displayed on the monitor 19B, associating each of a plurality of portions of the structure constituting the upper slewing body 12 of the hydraulic excavator 10 with their corresponding fatigue index values. FIG. 7C shows an example of the image G displayed on the monitor 19B, associating each of a plurality of portions of the structure constituting the lower traveling body 11 of the hydraulic excavator 10 with their corresponding fatigue index values. Similarly to the example of FIG. 7A, these examples also provide a visual indication of the fatigue index values for various portions of the components of the hydraulic excavator 10.

The movement identification device 100 of the present embodiment enables setting of the weighting of the cumulative damage degree by the stress calculation unit 113 so that the fatigue index value is larger at a site where access is difficult, such as a mine in a remote area, than at a site where access is easy. This makes it possible to request inspections of the construction machine operated at sites where access is difficult at an earlier time than at sites that are easily accessible, thereby enabling highly accurate fatigue management of construction machines according to the site environment.

The movement identification device 100 of the present embodiment also enables setting of the weighting of the cumulative damage degree by the stress calculation unit 113 so that the fatigue index value is larger for the components of the construction machine that take a longer time to be replaced or repaired or the portions that are more difficult in maintenance than for other components and portions. This enables highly accurate fatigue management of construction machines according to the characteristics of the components of the construction machine and the ease of maintenance of each portion.

In the movement identification device 100 of the present embodiment, the sensor 18 includes a force sensor that detects a force acting on the construction machine, and an attitude sensor that detects the attitude of the construction machine. Conventionally such force sensor and attitude sensor have been installed in the construction machine for purposes of understanding the operating conditions of the construction machine and avoiding accidents that are different from the purpose of calculating stresses acting on various portions of the construction machine. The present embodiment therefore does not require the installment of a sensor such as a strain gauge in the construction machine just for calculating the stress.

The movement identification device 100 of the present embodiment includes the index value calculation unit 115 that functions as the comparison unit that compares a degree of fatigue based on time series data of the fatigue index value. With this configuration, the present embodiment enables comparison of the degree of fatigue of a specific portion of a construction machine with the threshold for more accurate management of the degree of fatigue of the specific portion of the construction machine. This also enables a comparison of the degree of fatigue among multiple construction machines.

Figure 8:
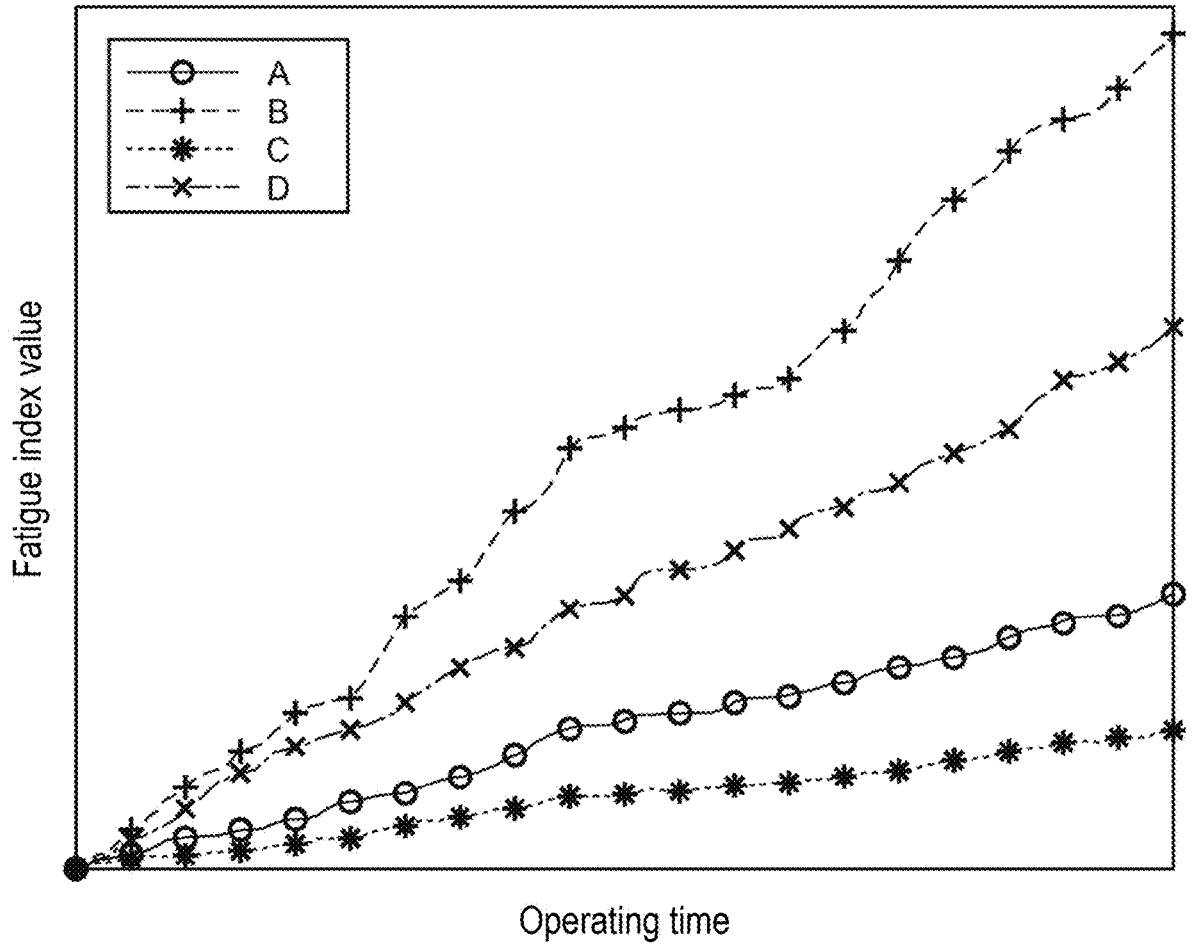
FIG. 8 is a graph showing an example of time-series data of the fatigue index values of a plurality of construction machines.

FIG. 8 is a graph showing an example of time-series data of the fatigue index values of a plurality of construction machines. Specifically, FIG. 8 shows time-series data of the fatigue index values at a specific potion of the booms 14*a* of the four hydraulic excavators 10 of A to D among the plurality of hydraulic excavators 10. In the example of FIG. 8, the index value calculation unit 115 as the comparison unit compares the degree of fatigue of the hydraulic excavators 10 based on the time-series data of the fatigue index values of the four hydraulic excavators A to D. This comparison shows that the fatigue degree of machine B is the highest and that of machine C is the lowest.

The movement identification device 100 of the present embodiment clarifies the correlation between a specific motion and a fatigue index value, for example. This makes it possible to create an appropriate work plan according to the fatigue degree of each hydraulic excavator 10 by placing a hydraulic excavator 10 with a high fatigue degree to the work with a low load and placing a hydraulic excavator 10 with a low fatigue degree to the work with a high load, for example.

As described above, the present embodiment provides the movement identification device 100 capable of identifying the type of a motion of a construction machine based on the output of a sensor attached to the construction machine with higher accuracy than the conventional technology. The present embodiment provides the movement identification device 100 that uses fatigue index values and so is capable of managing fatigue of each portion of a construction machine more accurately than conventional technology.

Embodiment 2

Figure 9:
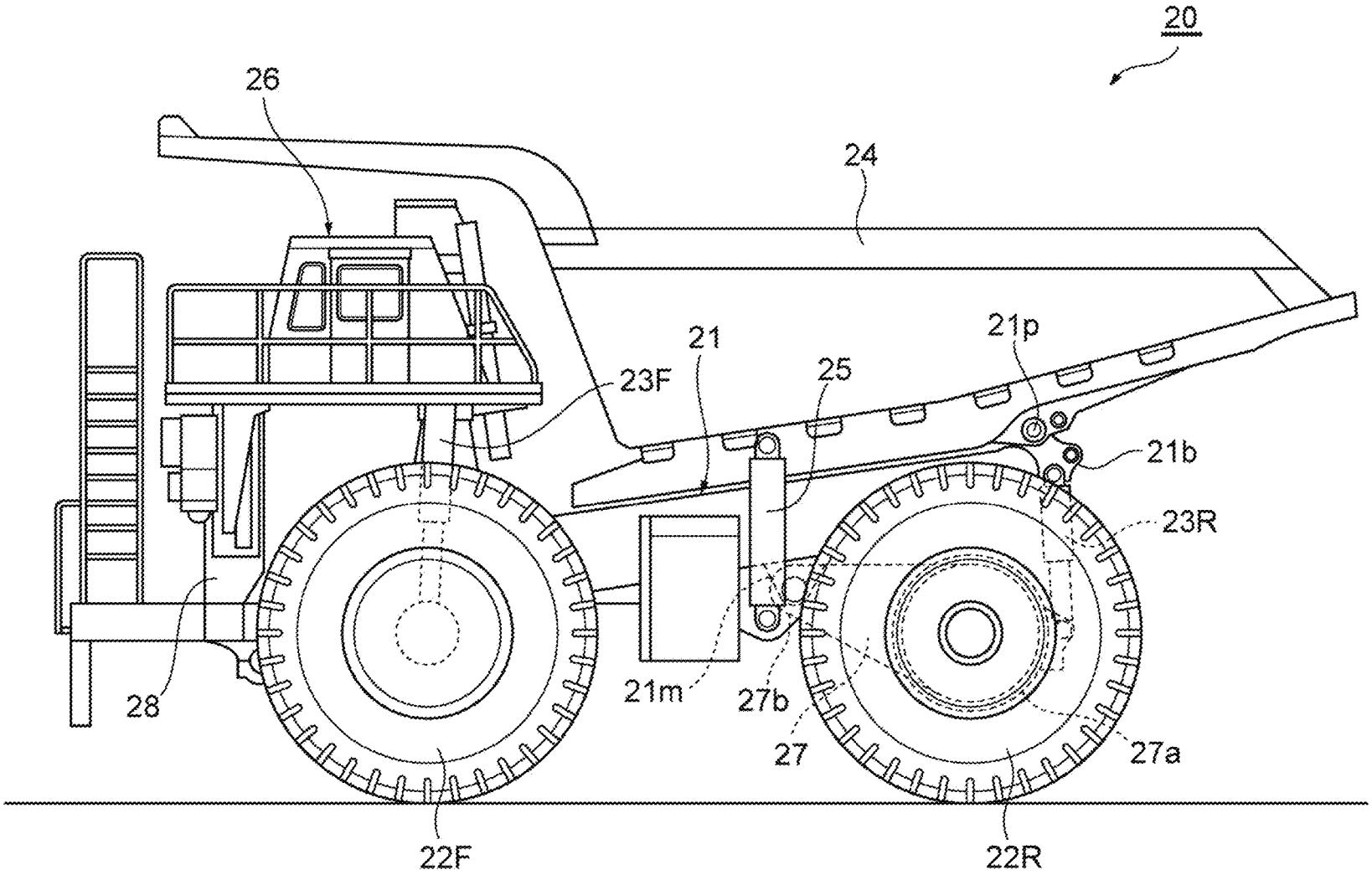
FIG. 9 is a side view of a dump truck equipped with a movement identification device according to Embodiment 2 of the present disclosure.

Next referring to FIG. 9 to FIG. 12 together with FIG. 2, the following describes a movement identification device according to Embodiment 2 of the present disclosure. FIG. 9 is a side view of a dump truck 20 equipped with a movement identification device 100 according to Embodiment 2 of the present disclosure.

The movement identification device 100 of the present embodiment is different from the movement identification device 100 of Embodiment 1 as described above in that the construction machine to be managed is the dump truck 20. Since the movement identification device 100 of the present embodiment is similar to the movement identification device 100 of Embodiment 1 in other respects, the same numerals indicate like parts, and their descriptions are omitted. The following firstly describes an example of the configuration of the dump truck 20, and then describes the action of the movement identification device 100 of the present embodiment.

(Dump Truck)

In one example, a dump truck 20 shown in FIG. 9 is a large transport vehicle that transports objects to be transported, such as quarried stones from a mine. In one example, the dump truck 20 has a body frame 21, left and right front wheels 22F, left and right rear wheels 22R, left and right front-wheel side suspensions 23F, left and right rear-wheel side suspensions 23R, a body 24, left and right hoist cylinders 25, a cab 26, a traveling drive system 27, and a housing 28.

In one example, the body frame 21 is a frame-like structure that supports the front wheels 22F, the rear wheels 22R, the front-wheel side suspensions 23F, the rear-wheel side suspensions 23R, the body 24, the hoist cylinders 25, the cab 26, the traveling drive system 27, and the housing 28.

The left and right front wheels 22F are steering wheels rotatably supported at the front portion of the body frame 21. The left and right rear wheels 22R are drive wheels rotatably supported at the rear portion of the body frame 21. The left and right front-wheel side suspensions 23F are mounted at the front of the body frame 21 and elastically support the left and right front wheels 22F.

The left and right rear-wheel side suspensions 23R are mounted at the rear of the body frame 21 and elastically support the left and right rear wheels 22R. The upper ends of the left and right rear-wheel side suspensions 23R are attached to the left and right brackets 21*b* provided to the rear of the body frame 21. The lower ends of the left and right rear-wheel side suspensions 23R are attached to an axel housing 27*a* of the travelling drive system 27.

The cylinders of the front-wheel side suspensions 23F and the rear-wheel side suspensions 23R of the dump truck 20 each include a hydraulic sensor similar to the hydraulic sensor 18*b* of the hydraulic excavator 10. In one example, the hydraulic sensors of the dump truck 20 are force sensors that detect forces acting on the front-wheel side suspensions 23F and the rear-wheel side suspensions 23R.

The body 24 is a large container that is tiltably mounted on the body frame 21 and has a length of more than 10 meters in the front-rear direction of the dump truck 20, for example. The body 24 carries a large amount of mined crushed stone, for example. In one example, the rear portion of the body 24 at the bottom is connected to the left and right brackets 21*b* of the body frame 21 via connecting pins 21*p*, and the front portion at the bottom is connected to the upper end of the hoist cylinders 25.

The left and right hoist cylinders 25 each have a lower end that is rotatably connected to the body frame 21 and an upper end that is rotatably connected to the body 24. In one example, the hoist cylinders 8 are hydraulic cylinders. This configuration allows the body 24 to, in response to the expansion of the hoist cylinders 25, rotate around the connecting pins 21*p*, so as to tilt to the discharge position where the front portion is located above and the rear portion is located below. When the hoist cylinders 25 contracts from this state, the body 24 rotates in the reverse direction around the connecting pins 21*p* and returns to the loading position shown in FIG. 9.

The traveling drive system 27 is connected to the left and right rear wheels 22R and rotationally drives them. In one example, the traveling drive system 27 has an axle housing 27*a* and a bracket 27*b*. In one example, the axle housing 27*a* has a cylindrical shape extending to the left and right, accommodating a traveling motor, a speed reducer, and the like, which are not shown in the drawing. In one example, the bracket 27*b* projects forward from the axle housing 27*a*. The front end of the bracket 27*b* is rotatably attached to a mount 21*m* of the body frame 21.

The housing 28 defines a machine room at the front of the body frame 21. The housing 28 accommodates an engine, a hydraulic pump, and the like, which are not shown in the drawing. The cab 26 is placed on a flat floor located at the top of the housing 28. The cab 26 has a box shape, and defines the driver's cabin in which the operator boards. Although not shown, a seat on which the operator sits, a steering wheel, an operation pedal, and the like are installed in the cab 26.

In one example, the dump truck 20 includes a controller similar to the controller 15 for the hydraulic excavator 10 shown in FIG. 2. In one example, the controller of the dump truck 20 includes a waveform generation unit 111, a motion identification unit 112, and a waveform storage unit 121. The dump truck 20 also includes an attitude sensor for detecting the attitude of the dump truck 20. In one example, the attitude sensor includes an acceleration sensor. In one example, the dump truck 20 includes a transmitter 19A and a monitor 19B shown in FIG. 2.

Figure 10:
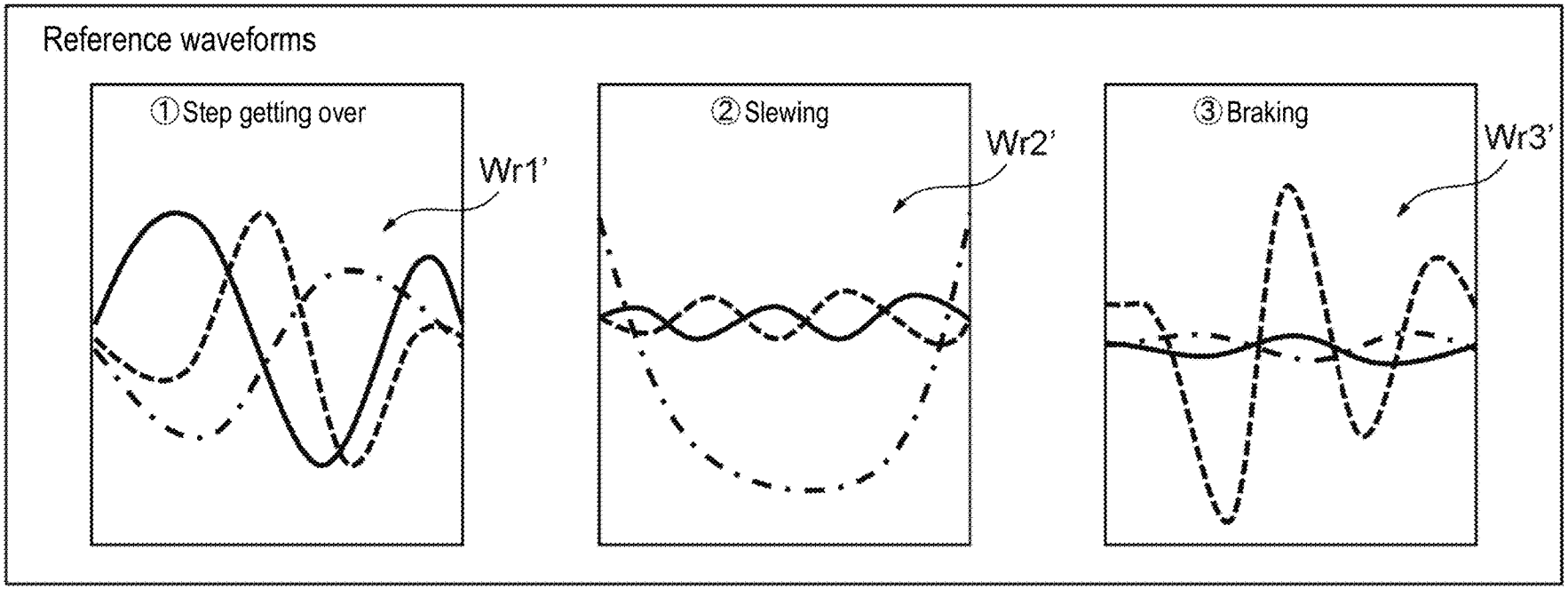
FIG. 10 shows one example of reference waveforms stored in a waveform storage unit of the movement identification device of FIG. 2.

FIG. 10 shows one example of the reference waveforms Wr1', Wr2', and Wr3', each of which is a reference waveform for a motion and includes a plurality of pieces of waveform data that are combinations of force waveforms and attitude waveforms. These reference waveforms are stored in the waveform storage unit 121 of the movement identification device 100 of FIG. 2. The reference waveform Wr1' of the motion of getting over a step, indicated by the circled number 1 in FIG. 10, is the reference waveform of the motion in which the front wheels 22F and the rear wheels 22R of the dump truck 20 ride on a step and getting over the step, for example. The reference waveform Wr2' of the slewing motion, indicated by the circled number 2 in FIG. 10, is the reference waveform of the motion in which the dump truck 20 turns in response to turning of the front wheels 22F as the steering wheels, for example. The reference waveform Wr3' of the braking motion, indicated by the circled number 3 in FIG. 10, is the reference waveform of the motion in which the dump truck 20 decelerates, for example. The motions corresponding to the reference waveforms stored in the waveform storage unit 121 are not particularly limited, and the waveform storage unit 121 can store reference waveforms corresponding to arbitrary motions.

Figure 11:
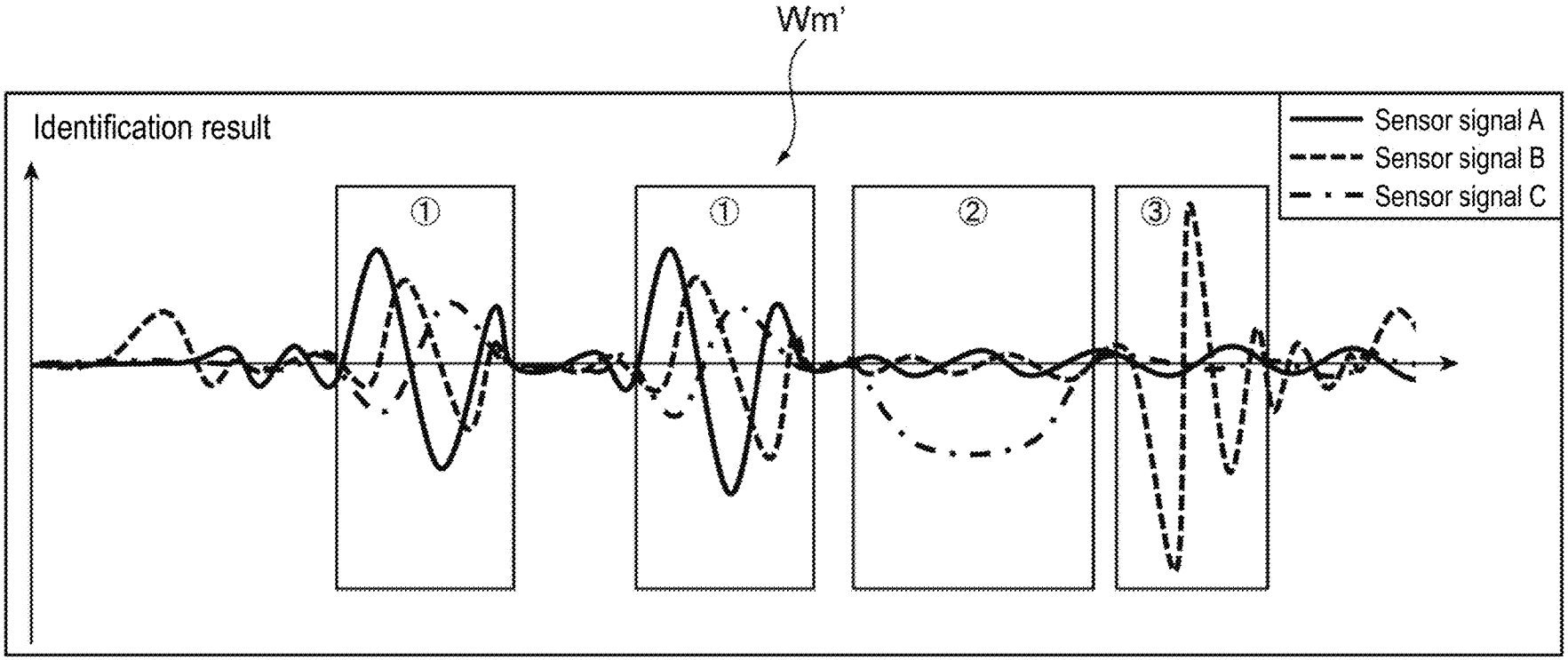
FIG. 11 shows one example of the identification of specific motions by the motion identification unit of the movement identification device of FIG. 2.

FIG. 11 shows one example of the identification of specific motions by the motion identification unit 112 of the movement identification device 100 of FIG. 2. In FIG. 11, the combination of the waveforms of sensor signal A shown by the solid line, the sensor signal B shown by the broken line, and the sensor signal C shown by the dashed-dotted line is the motion waveform Wm' when the dump truck 20 moves. The motion waveform Wm' is a combination of at least one force waveform and at least one attitude waveform, corresponding to an arbitrary motion of the dump truck 20.

Similarly to Embodiment 1, the motion identification unit 112 identifies the specific motions included in the motion waveform Wm', i.e., the motions of the circled numbers 1 to 3 shown in FIG. 10. In the example shown in FIG. 11, the motion identification unit 112 identifies two times of the step getting over motion indicated by the circled number 1, one time of the slewing motion indicated by the circled number 2, and one time of the braking motion indicated by the circled number 3, from the motion waveform Wm' of the dump truck 20 for a predetermined period.

(Movement Identification Device)

Next the following describes the action of the movement identification device 100 of the present embodiment. Similarly to the hydraulic excavator 10 as described above, the movement identification device 100 of the present embodiment identifies a type of a motion of the dump truck 20 also with higher accuracy than conventional technology.

Specifically, the movement identification device 100 of the present embodiment includes the waveform generation unit 111, the motion identification unit 112, and the waveform storage unit 121 as described above. The movement identification device 100 is configured so that the waveform generation unit 11 generates a force waveform based on the signal of the hydraulic sensor 18*b* that detects the hydraulic pressure acting on the front-wheel side suspensions 23F and the rear-wheel side suspensions 23R of the dump truck 20, and an attitude waveform based on the signal of the attitude sensor that detects the attitude of the dump truck 20. The motion identification unit 112 stores reference waveforms Wr1', Wr2', and Wr3', which are combinations of force waveforms and attitude waveforms corresponding to specific motions of the dump truck 20. Further, the stress calculation unit 113 compares a motion waveform Wm', which is a combination of a force waveform and an attitude waveform corresponding to an arbitrary motion of the dump truck 20, with the reference waveforms Wr1', Wr2', and Wr3' stored in the waveform storage unit 120 to identify a specific motion in the arbitrary motion of the dump truck 20.

With this configuration, when the dump truck 20 is not performing a specific motion, the force waveform based on the signal of the hydraulic sensor 18*b* included in the motion waveform Wm' of the dump truck 20 will be different from the force waveform included in the reference waveforms Wr1', Wr2', and Wr3'. When the dump truck 20 is not performing a specific motion, the attitude waveform based on the signal of the acceleration sensor, for example, included in the motion waveform Wm' may be similar to or the same as the attitude waveform included in the reference waveforms Wr1', Wr2', and Wr3'. Even in this case, the present embodiment prevents erroneous identification of a specific motion. Thus, the movement identification device 100 of the present embodiment is capable of identifying a type of a motion of the dump truck 20 based on the outputs of the sensor 18 attached to the dump truck 20 with higher accuracy than conventional technology.

The movement identification device 100 includes the stress calculation unit 113, the damage degree calculation unit 114, and the index value calculation unit 115. Similarly to the hydraulic excavator 10 as stated above, the movement identification device 100 of the present embodiment enables fatigue management of each portion of the dump truck 20 more accurately than the conventional systems, according to the conditions specific to each dump truck 20, each component of the dump truck 20, and each of a plurality of portions of the components, for example.

Figure 12:
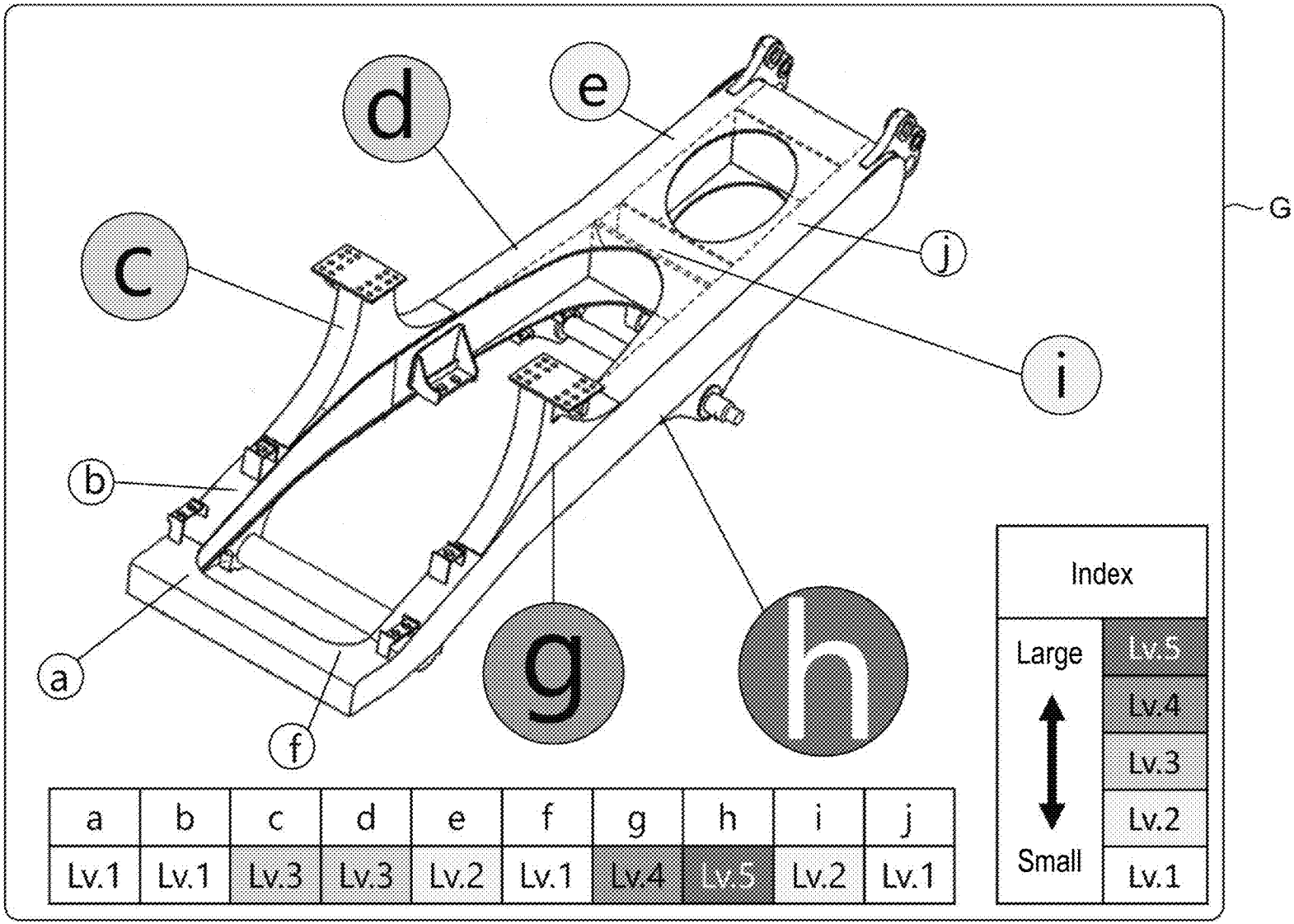
FIG. 12 shows an example of the image displayed on the monitor in the fatigue management system shown in FIG. 1.

FIG. 12 shows an example of a monitor image of the movement identification device 100 of the present embodiment. FIG. 12 shows an example of the image G displayed on the monitor 19B, associating each of a plurality of portions of the body frame 21 of the dump truck 20 with their corresponding fatigue index values. Similarly to the example of FIGS. 7A to 7C, the movement identification device 100 of the present embodiment also provides a visual indication of the fatigue index values for various portions of the components of the dump truck 20.

That is a detailed description of the embodiments of the movement identification device of the present disclosure, with reference to the drawings. The specific configuration of the present disclosure is not limited to the above-stated embodiments, and the design may be modified variously without departing from the spirits of the present disclosure. The present disclosure also covers such modified embodiments.

REFERENCE SIGNS LIST

1 Hydraulic cylinder
10 Hydraulic excavator (construction machine)
18*a* Angle sensor (attitude sensor)
18*b* Hydraulic sensor (force sensor)
18*c* Angular rate sensor (attitude sensor)
18*d* Acceleration sensor (attitude sensor)
18*e* Inclination angle sensor (attitude sensor)
20 Dump truck (construction machine)
100 Movement identification device
111 Waveform generation unit
112 Motion identification unit
113 Stress calculation unit
114 Damage degree calculation unit
115 Index value calculation unit (comparison unit)
121 Waveform storage unit
Wm Motion waveform
Wm' Motion waveform
Wr1 Reference waveform
Wr1' Reference waveform
Wr2 Reference waveform
Wr2' Reference waveform
Wr3 Reference waveform
Wr3' Reference waveform

The invention claimed is:

1. A movement identification device comprising: a waveform generation unit configured to generate a force waveform that is time-series data of a signal from a force sensor that detects a force acting on a construction machine and an attitude waveform that is time-series data of a signal from an attitude sensor that detects an attitude of the construction machine;

a waveform storage unit that stores a reference waveform, which is a combination of at least one of the force waveform and at least one of the attitude waveform corresponding to a specific motion of the construction machine, the reference waveform being stored for each motion; and a motion identification unit configured to compare a motion waveform, which is a plurality of combinations of the force waveform and the attitude waveform corresponding to an arbitrary motion of the construction machine for a certain time period, with the reference waveform to identify the specific motion contained in the arbitrary motion.

2. The movement identification device according to claim 1, wherein the waveform storage unit stores a plurality of different reference waveforms as the reference waveform corresponding to a plurality of different specific motions as the specific motion.

3. The movement identification device according to claim 1, further comprising: a stress calculation unit configured to calculate stress acting on a plurality of portions of the construction machine based on an output of the force sensor and the attitude sensor;

a damage degree calculation unit configured to calculate a cumulative damage degree of each of the portions based on the stress; and an index value calculation unit configured to calculate a fatigue index value, which is a weighted value of the cumulative damage degree, for each portion.

4. The movement identification device according to claim 3, further comprising a comparison unit configured to compare a degree of fatigue based on time series data of the fatigue index value.

* * * * *